US006352418B1

(12) United States Patent
Kohsokabe et al.

(10) Patent No.: US 6,352,418 B1
(45) Date of Patent: Mar. 5, 2002

(54) DISPLACEMENT TYPE FLUID MACHINE

(75) Inventors: Hirokatsu Kohsokabe, Minori; Kunihiko Takao, Tsuchiura; Masahiro Takebayashi, Oohira; Isao Hayase, Tsuchiura; Hiroaki Hata, Oohira; Shigetaroo Tagawa, Iwafune; Kenji Tojo, Moriya; Takeshi Kouno, Ushiku, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/520,849

(22) Filed: Mar. 8, 2000

(30) Foreign Application Priority Data

May 12, 1999 (JP) ..... 11-131300

(51) Int. Cl.[7] ..... F01C 1/02

(52) U.S. Cl. ..... 418/61.1; 418/57; 418/94; 418/151

(58) Field of Search ..... 418/61.1, 94, 151, 418/57

(56) References Cited

U.S. PATENT DOCUMENTS 196,732 A * 10/1877 Winkler ..... 418/57
1,789,842 A * 1/1931 Rolaff ..... 418/57
3,520,644 A * 7/1970 Kalkbrenner ..... 418/57
4,219,314 A * 8/1980 Haggerty ..... 418/57

FOREIGN PATENT DOCUMENTS

JP 09-268987 A * 10/1997 ..... 418/61.1

OTHER PUBLICATIONS

Japanese Patent Unexamined Publication No. 55–23353.
U.S. Patent No. 2112890.
Japanese Patent Unexamined Publication No. 5–202869.
Japanese Patent Unexamined Publication No. 6–280758.
Japanese Patent Unexamined Publication No. 9–268987.
Japanese Patent No. 2689659 (Japanese Patent Unexamined Publication No. 3–175188).
Japanese Patent No. 2690810.

* cited by examiner

*Primary Examiner*—Thomas Denion
*Assistant Examiner*—Theresa Trieu
(74) *Attorney, Agent, or Firm*—Antonelli, Terry, Stout & Kraus, LLP

(57) ABSTRACT

A displacement type fluid machine which is easier to machine and assemble than a scroll type fluid machine and has high performance and low cost. A displacer is revolved in a cylinder having an inside wall formed by a curve such that a planar shape is continuous, whereby a working fluid is discharged through a plurality of discharge ports, there is provided a driving unit in which the orbiting radius of the displacer is variable along the shape of a movement line contact portion of the cylinder and the displacer.

20 Claims, 16 Drawing Sheets

DISPLACEMENT TYPE FLUID MACHINE

BACKGROUND OF THE INVENTION

The present invention relates to a fluid machine such as a pump, a compressor, and an expansion machine and, more particular, to a displacement type fluid machine.

As a displacement type fluid machine, there have been conventionally known a reciprocating fluid machine which moves a working fluid by repeated reciprocating motion of a piston in a cylindrically shaped cylinder, a rotary type (rolling piston type) fluid machine which moves a working fluid by eccentric rotational motion of a piston in a cylindrically shaped cylinder, and a scroll type fluid machine which moves a working fluid by engaging a pair of a fixed scroll and an orbiting scroll having a spiral wrap erected on an end plate and by revolving the orbiting scroll.

The reciprocating fluid machine has an advantage that it is easy to manufacture and less costly because the construction thereof is simple. However, it has a problem in that the performance is decreased due to the increase in pressure loss because a process from the completion of suction to the completion of discharge is as short as 180° in terms of the rotation angle of driving shaft, so that the flow velocity in the discharge process is high. It also has a problem in that vibration and noise are great because a motion for reciprocating the piston is needed, so that the unbalanced inertia force of the driving shaft system cannot be balanced.

Also, the rotary type fluid machine has a less problem in that the pressure loss increases in the discharge process because a process from the completion of suction to the completion of discharge is 360° in terms of the rotation angle of driving shaft. However, like the reciprocating fluid machine, it also has a problem in that vibration and noise are great because the fluid is discharged once every one rotation of shaft, so that the fluctuations in gas compression torque are relatively large.

Further, the scroll type fluid machine has an advantage that the pressure loss in the discharge process is low because a process from the completion of suction to the completion of discharge is 360° or longer in terms of the rotation angle of driving shaft (normally about 900° for the machine practically used for air conditioning), and vibration and noise are low because a plurality of working chambers are generally formed, so that the fluctuations in gas compression torque during one rotation are small. However, a clearance between spiral wraps in a wrap engaging state and a clearance between the end plate and a wrap tip must be controlled, which leads to a problem in that highly accurate machining is needed, which increases the machining cost. Also, the scroll type fluid machine has a problem in that a process from the completion of suction to the completion of discharge is as long as 360° or longer in terms of the rotation angle of driving shaft and internal leakage increases as the period for compression process increases.

JP-A-55-23353 (Literature 1), U.S. Pat. No. 2,112,890 (Literature 2), JP-A-5-202869 (Literature 3), and JP-A-6-280758 (Literature 4) have proposed a type of a displacement type fluid machine which carries a working fluid by a revolving motion with a substantially constant radius without the relative rotation of a displacer for moving the working fluid with respect to a cylinder into which the working fluid is sucked, that is, by an orbital motion. The displacement type fluid machine proposed therein comprises a displacer having a petal shape in which a plurality of members (vanes) extend radially from the center, and a cylinder having a hollow portion having a figure substantially similar to the displacer. The working fluid is moved by the orbital motion of the displacer in the cylinder.

In the displacement type fluid machine shown in the Literatures 1 to 4, the imbalance of the driving shaft system can be balanced because the machine has no reciprocating part unlike the reciprocating fluid machine. Therefore, the machine has an advantage that vibration is low, and the frictional loss can be made relatively low because the relative sliding velocity between the displacer and the cylinder is low.

However, a process from the completion of suction to the completion of discharge in an individual working chamber formed by the plurality of vanes composing the displacer and the cylinder is as short as about 180° (210°) in terms of the rotation angle θc of driving shaft (about half of that of the rotary type and nearly the same as that of the reciprocating type), which presents a problem in that the flow rate of the fluid in the discharge process increases and the pressure loss increases, resulting in a decrease in performance. Also, in the fluid machine shown in these literatures, the rotation angle of driving shaft is small in a period from the completion of suction to the completion of discharge in the individual working chamber, and there is a time shift (time lag) from the time when the discharge of working fluid is completed to the time when the next (compression) process begins (completion of suction). Therefore, the mechanical balance is poor because the working chamber is formed eccentrically around the driving shaft from the completion of suction to the completion of discharge, so that a rotating moment for rotating the displacer itself excessively acts on the displacer as a reaction force from the compressed working fluid, which is liable to cause a reliability problem such as the friction and wear of the vane.

A displacement type fluid machine that has solved the above problems has been disclosed in JP-A-9-268987, which has been proposed by the inventors of the present invention. In this machine, the inside wall surface of cylinder and the outside wall surface of displacer are formed so that among a plurality of spaces formed between the displacer and the cylinder, the maximum number of the spaces for the process from the completion of suction to the completion of discharge becomes a predetermined number, whereby the fluid loss is decreased. However, sufficient consideration has not been given to decrease the internal leakage of working fluid at the seal point of the cylinder and the displacer and to enhance the assembling ability and reliability of parts.

In the scroll type fluid machine, as means for decreasing the internal leakage between the wraps of the fixed scroll and the orbiting scroll, a mechanism has been known which allows the movement of the orbiting scroll in the radial outside direction and brings the wraps of the fixed scroll and the orbiting scroll into sealing contact. For example, Japanese Patent Publication No. 2689659 (Literature 5), Japanese Patent Publication No. 2690810 (Literature 6), etc. have disclosed this mechanism.

The internal leakage decreasing mechanism for the scroll type fluid machine shown in the Literatures 5 and 6 shows an example applied to a cantilever type construction in which the driving shaft does not penetrate the orbiting scroll, a movable part, and the driving shaft is supported on one side of the compression element portion. A both-end-supported construction in which both ends of the movable part are supported by a bearing is mechanically complex, so that it has a disadvantage that the application of this technique is difficult and the machining cost increases. Also, an Oldham's ring etc. are generally used to prevent the rotation of the orbiting scroll, and a mechanism separate from the internal leakage decreasing mechanism is provided, which leads to the increase in the machining manpower, the number of parts, and the cost.

BRIEF SUMMARY OF THE INVENTION

A first object of the present invention is to provide a displacement type fluid machine which is easier to machine and assemble than a scroll type fluid machine and has a low cost and high performance attained by an effective decrease in internal leakage.

A second object of the present invention is to provide a highly reliable displacement type fluid machine in which the rotating moment acting on a displacer is decreased to the utmost.

A third object of the present invention is to provide inexpensive orbiting radius variable means.

The above first object is attained by providing a displacement type fluid machine in which a displacer and a cylinder are disposed between end plates, one space is formed by the inside wall face of the cylinder and the outside wall face of the displacer when the center of the cylinder and the center of the displacer are aligned with each other, and a plurality of spaces are formed when the positional relationship between the displacer and the cylinder is formed so as to be an orbiting position, wherein there is provided driving means in which the orbiting radius of the orbital motion of the displacer changes along the shape of a movement line contact portion of the inside wall face of the cylinder and the outside wall face of the displacer at the time of actual operation.

The above second object is attained by providing a displacement type fluid machine comprising a cylinder having an inside wall composed of a curve such that a planar shape is continuous between end plates, and a displacer having an outside wall provided so as to be opposed to the inside wall of the cylinder, which is formed with a plurality of spaces by the inside wall, the outside wall, and the end plates at the time of orbital motion, wherein there is provided driving means in which when the displacer is revolved to compress a working fluid, part of a bearing load applied to a driving bearing of the displacer is applied as a seal force at a seal point between the displacer and the cylinder, and the planar shapes of the inside wall of the cylinder and the outside wall of the displacer are formed so as to be an alternating moment in which the direction of a rotating moment acting on the displacer is changed over.

The above third object is attained by providing a displacement type fluid machine comprising a cylinder having an inside wall composed of a curve such that a planar shape is continuous between end plates, a displacer having an outside wall provided so as to be opposed to the inside wall of the cylinder, which is formed with a plurality of spaces by the inside wall, the outside wall, and the end plates at the time of orbital motion, and a driving shaft for driving the displacer, wherein there are provided the driving shaft which has an eccentric portion formed with a planar portion in which the outside diameter face is partially cut away, and a substantially segment shaped slider having a partial cylinder shape which slides in engagement with the planar portion of the driving shaft and has a oil film pressure generating portion for supporting a load applied to a displacer driving bearing.

DETAILED DESCRIPTION OF THE INVENTION

Figure 1A:
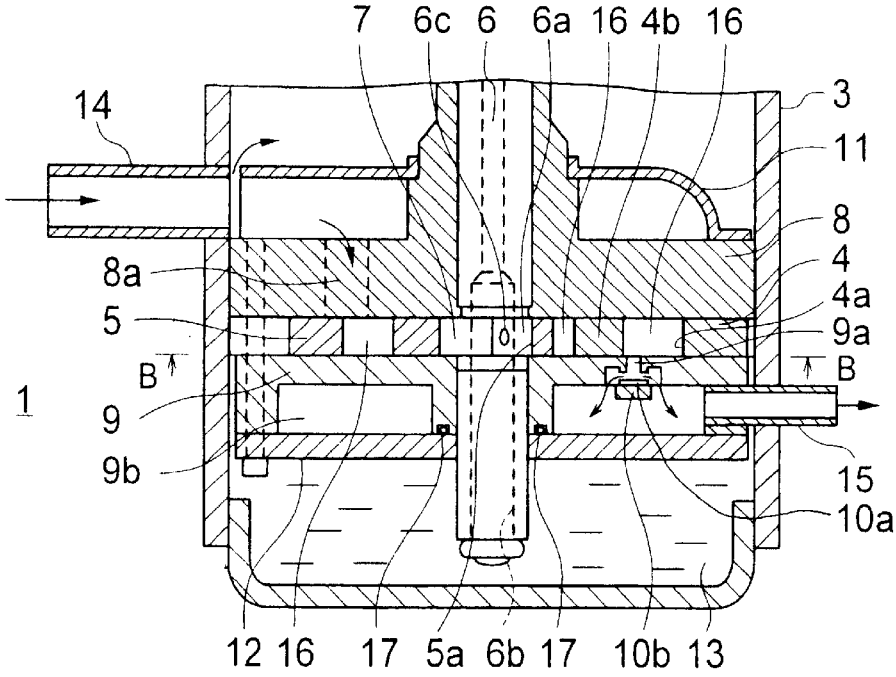
FIGS. 1A and 1B are a longitudinal sectional view and a plan view, respectively, of a compression element for a hermetic type compressor in the case where a displacement type fluid machine in accordance with the present invention is applied to a compressor.
Figure 1B:
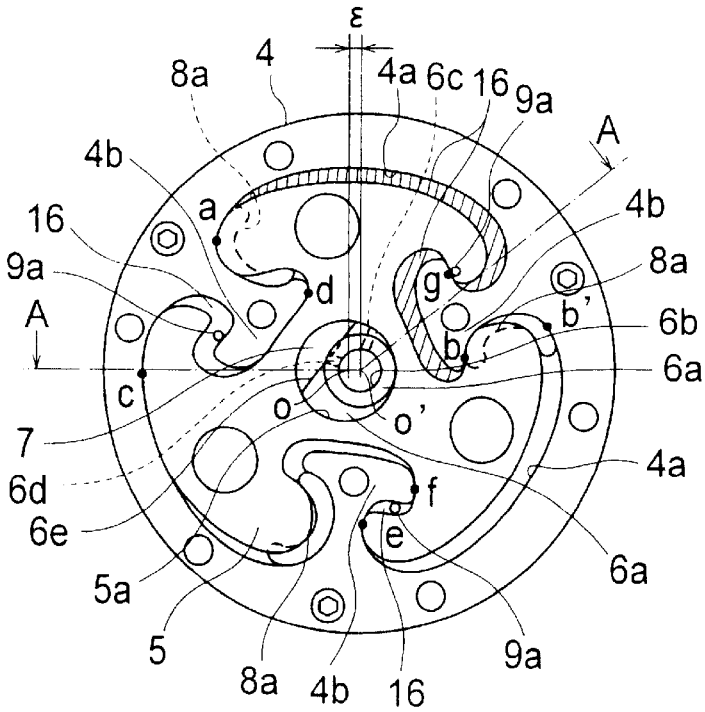

The above-described features of the present invention is further made apparent by the embodiments described below. Embodiments of the present invention will be described below with reference to the accompanying drawings. First, a construction of an orbiting type fluid machine in accordance with one embodiment of the present invention will be explained with reference to FIGS. 1 to 3. FIG. 1A is a longitudinal sectional view showing an essential portion of a hermetic type compressor in the case where a displacement type fluid machine in accordance with one embodiment of the present invention is used as a compressor (a sectional view taken along a line A—A of FIG. 1B). FIG. 1B is a plan view, which is a view taken in the direction of the arrows along a line B—B of FIG. 1A, showing a state in which a compression chamber is formed. FIGS. 2A to 2D are views showing the operation principle of a displacement type compression element. FIG. 3 is a longitudinal sectional view of a hermetic type compressor in a case where a displacement type fluid machine in accordance with one embodiment of the present invention is used as a compressor.

Referring to FIGS. 1A and 1B, a hermetic casing 3 contains a displacement type compression element 1 and an electrically driving element 2 (not shown) for driving the compression element 1. The details of the displacement type compression element 1 will now be explained. FIG. 1B shows three wraps in which three sets of the same contours are combined. The inner peripheral shape of a cylinder 4 is formed so that the same shape of hollow portion appears every 120° (center o'). At the end of the individual hollow portion, there are provided a plurality of (in this case, three because of three wraps) peninsula-shaped vane 4*b* projecting inward. A displacer 5 is disposed on the inside of the cylinder 4 so that the center thereof is shifted by $\epsilon$ from the center of the cylinder 4 in such a manner as to engage with an inner peripheral wall 4*a* (a portion having a larger curvature than that of the vane 4*b*) and the vanes 4*b* of the cylinder 4. If the center o' of the cylinder 4 and the center o of the displacer 5 are caused to agree with each other, a gap with a fixed width is formed as a basic shape between the contours of these elements.

Next, the operation principle of the displacement type compression element 1 will be explained with reference to FIGS. 1A and 1B and FIGS. 2A to 2D. Reference character o denotes the center of the displacer 5, and reference character o' denotes the center of the cylinder 4 (or a driving shaft 6). Reference characters a, b, c, d, e and f denote contact points (seal points) of engagement of the displacer 5 with the inner peripheral wall 4*a* and the vanes 4*b* of the cylinder 4. Regarding the inner peripheral contour of the cylinder 4, the combinations of the same curves are smoothly connected at three places. Paying attention to one place of these places, a curve forming the inner peripheral wall 4*a* and the vanes 4*b* can be regarded as one vortex curve with a thickness (the tip end of the vane 4*b* is considered to be the start of vortex). The inside wall curve (g-a) is a vortex curve with a winding angle of about 360° (this means that although the design concept is 360°, this accurate value cannot be obtained because of manufacturing error etc.), which is the sum of all arc angles constituting the curve, and the outside wall curve (g-b) is a vortex curve with a winding angle of about 360°. Thus, the inner peripheral contour at one place is formed by the inside wall curve and the outside wall curve. The spiral outside wall curve and inside wall curve, which are disposed at almost equal intervals (120° because of three wraps) on the two curve circumferences and adjacent to each other, are connected by a smooth connecting curve (b–b') such as an arc, by which the whole of the inner peripheral contour of the cylinder 4 is formed. The outer peripheral contour of the displacer 5 is formed on the same principle as that of the cylinder 4.

The spiral comprising three curves are disposed at almost equal intervals (120°) on the circumference. This is because loads caused by the compression operation is distributed uniformly and consideration is given to the ease of manufacture. If these do not especially present a problem, non-uniform intervals are allowed.

The compression operation carried out by using the cylinder 4 and the displacer 5 thus constructed will be described with reference to FIGS. 2A to 2D. Reference numerals 8*a* and 9*a* are a suction port and a discharge port, respectively. These ports are provided on a corresponding end plate at three places. By rotating the driving shaft 6, the displacer 5 revolves with an orbiting radius $\epsilon$ (=oo') without rotating around the center o' of the cylinder 4 on the fixing side. There is a space configured by a stage in which suction is completed and compression (discharge) is performed, out of plural spaces surrounded and sealed by plural working chambers 16 configured by a cylinder inner peripheral contour (inside wall) and a displacer outer peripheral contour (side wall) around the center o of the displacer 5. That is, it is the space which is a period from the time of the completion of suction to the time of the completion of discharge. Only in the case where the winding angle is 360°, this space is eliminated at the time of the completion of compression, but the suction is also finished at this moment, so that this space is counted as one.

However, when this machine is used as a pump, working chambers (spaces communicating with the outside through a discharge port) are formed (in this embodiment, always three working chambers are formed). Explanation is given by paying attention to one hatched working chamber enclosed by the contact point a and the contact point b (this working chamber is separated into two at the time of the completion of suction, but the two working chambers are connected to one immediately after the compression process is started).

Figure 2A:
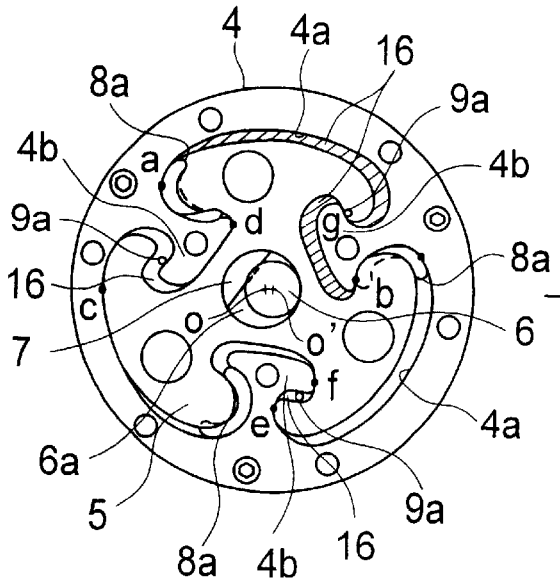
FIGS. 2A to 2D are explanatory views of the operation principle of a displacement type fluid machine in accordance with the present invention.
Figure 2B:
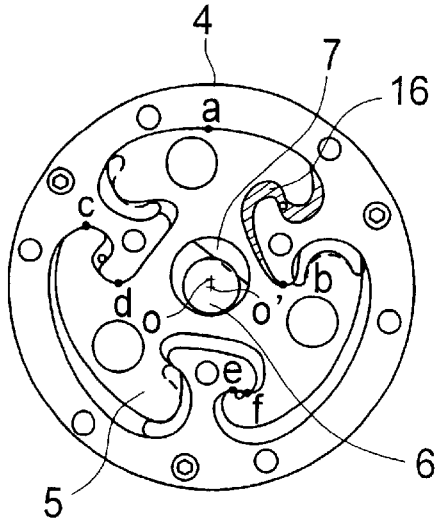
Figure 2D:
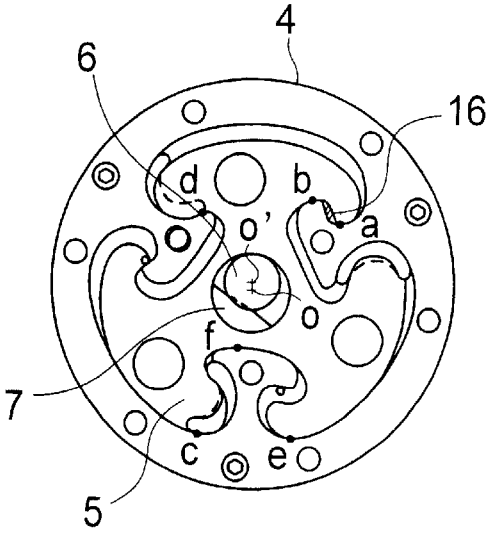
Figure 2C:
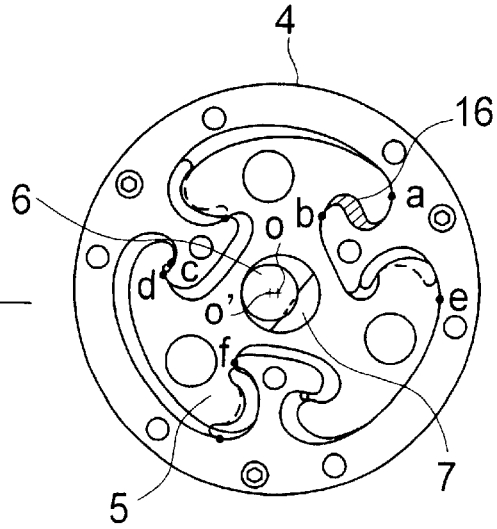
Figure 3:
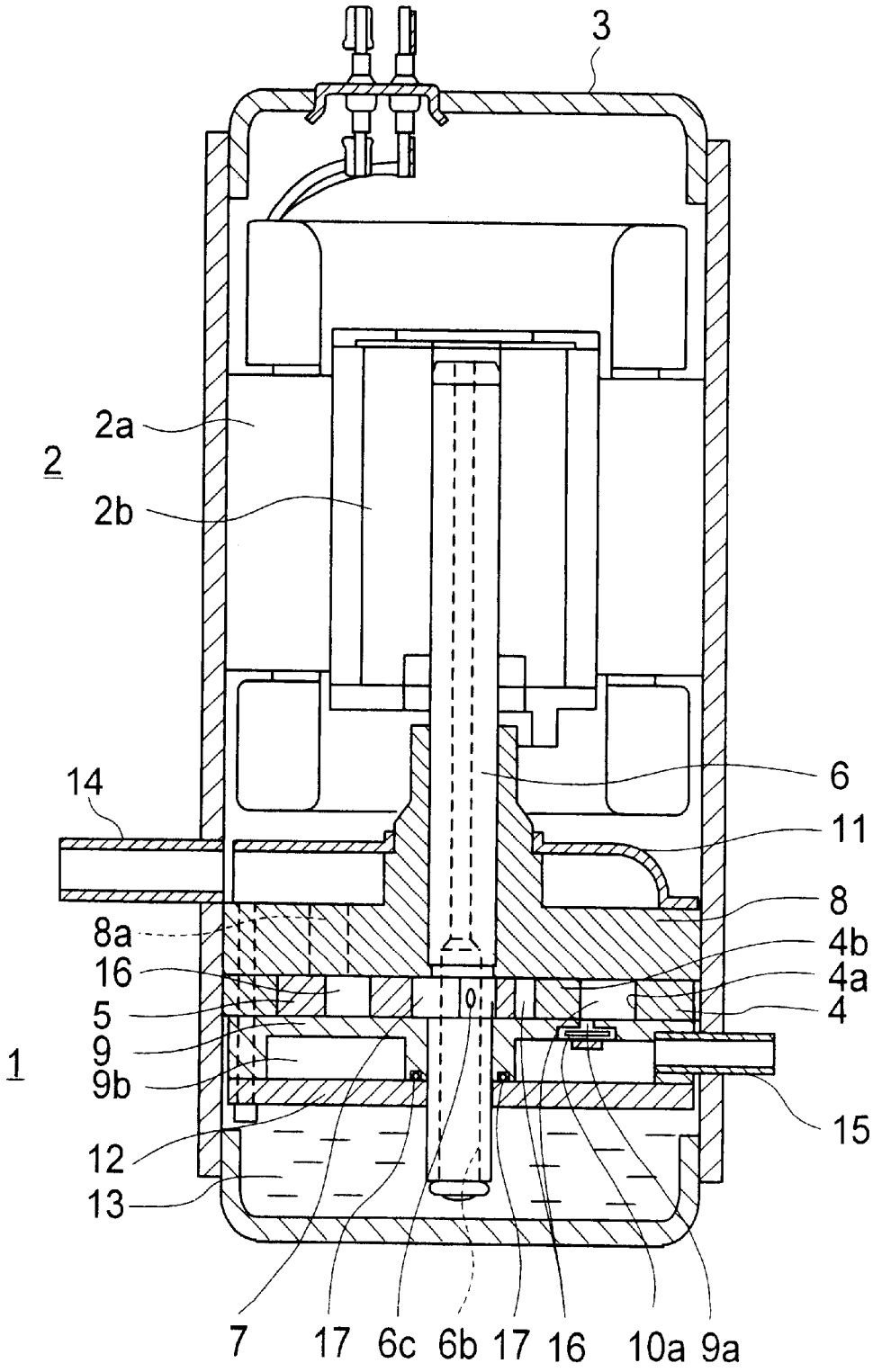
FIG. 3 is a longitudinal sectional view of a displacement type fluid machine in accordance with the present invention.

FIG. 2A shows a state in which the suction of working gas from the suction port 8*a* to this working chamber is completed. FIG. 2B shows a state in which the driving shaft 6 is rotated 90° clockwise from the state shown in FIG. 2A. FIG. 2C shows a state in which the rotation further proceeds and the driving shaft 6 is rotated 180° from the start. FIG. 2D shows a state in which the rotation further proceeds and the driving shaft 6 is rotated 270° from the start. When the driving shaft 6 rotates 90° from the state shown in FIG. 2D, the state returns to the initial state shown in FIG. 2A. Thereby, the volume of the working chamber 16 is decreased as the rotation proceeds, and the compression operation of working fluid is carried out because the discharge port 9*a* is closed by a discharge valve 10*a* (shown in FIG. 1). When the pressure in the working chamber 16 becomes higher than the discharge pressure on the outside, the discharge valve 10*a* is automatically opened by the pressure difference, and the compressed working gas is discharged through the discharge port 9*a*. Reference numeral 10*b* denotes a stopper for regulating the lift of the discharge valve 10*a*.

The rotation angle of the driving shaft from the completion of suction (the start of compression) to the completion of discharge is 360°, and the next suction process is prepared during the time when the processes of compression and discharge are carried out, so that the next compression process is started at the time of the completion of discharge. For example, paying attention to the space formed by the contact points a and d, the suction has already been started through the suction port 8*a* at the stage shown in FIG. 2A, and the volume thereof is increased as the rotation proceeds. When the state shown in FIG. 2D is established, this space is divided. The fluid corresponding to the divided amount is compensated by a space formed by the contact points b and e.

This compensating process will be described in detail. In the space formed by the contact points a and d, which are adjacent to the working chamber formed by the contact points a and b in the state shown in FIG. 2A, the suction has been started. After spreading once as shown in FIG. 2C, this space is divided in the state shown in FIG. 2D. Therefore, all of the fluid in the space formed by the contact points a and d is not compressed by the space formed by the contact points a and b. The fluid of the same amount as the volume of the fluid not taken in the space divided and formed by the contact points a and d is allotted by the fluid flowing into a space formed by the contact point e and the contact point b near the discharge port by dividing, as shown in FIG. 2A, the space formed by the contact points b and e in the suction process in FIG. 2D.

This is because the wraps are disposed at equal intervals as described above. That is to say, since the shapes of the displacer and the cylinder are formed by the repetition of the same contours, any working chamber can compress the fluid of nearly the same amount even if the fluid is provided from a different space. Even if the wraps are disposed at unequal intervals, machining can be performed so that the volume formed in each space is equal, but the manufacturing efficiency is poor. In any of the aforementioned prior arts, a certain space is closed in the suction process, and the fluid in this space is compressed and discharged as it is. Contrarily, the compression operation carried out in this manner by dividing a space in the suction process adjacent to the working chamber is one of the features of this embodiment.

As described above, the working chambers subjected to continuous compression operation are disposed by distributing at nearly the same intervals around a driving bearing 5*a* located at the central portion of the displacer 5, and the phases of the working chambers are shifted, whereby compression is carried out. That is to say, paying attention to one space, the rotation angle of the driving shaft from suction to discharge is 360°. In this embodiment, three working chambers are formed, and the fluid is discharged from these working chambers at a phase shifted 120°. Therefore, when this machine is operated as a compressor that compresses a refrigerant, which is the fluid, the refrigerant is discharged three times during 360° of the rotation angle of the driving shaft.

Assuming that the space (space enclosed by the contact points a and b) at a moment when the compression operation is completed is one space, when the winding angle is 360° as in the case of this embodiment, design is made so that the space serving for the suction process and the space serving for the compression process are alternate in any compressor's operating state. Therefore, at a moment when the compression process is completed, the next compression process can be started immediately, so that the fluid can be compressed smoothly and continuously.

Next, a compressor incorporating the displacement type compression element 1 having such a shape will be explained with reference to FIGS. 1A and 1B and FIG. 3. In FIGS. 1A and 1B and FIG. 3, the displacement type compression element 1 comprises, in addition to the cylinder 4 and the displacer 5 described above in detail, the driving shaft 6 for driving the displacer 5 by fitting a substantially segment shaped slider 7 disposed in the bearing 5*a* at the central portion of the displacer 5 in a form such that an eccentric portion 6*a* is partially cut away, a main bearing 8 and a subsidiary bearing 9 which are also used as bearings for pivotally supporting an end plate for closing both end opening portions of the cylinder 4 and the driving shaft 6, the suction port 8*a* formed in the end plate of the main bearing 8, the discharge port 9*a* formed in the end plate of the subsidiary bearing 9, and the discharge valve 10*a* which is opened/closed by the pressure difference. Reference numeral 11 denotes a suction cover installed to the main bearing 8, and 12 denotes a discharge cover for forming a discharge chamber 9*b* integrally with the subsidiary bearing 9.

The electrically driving element 2 consists of a stator 2*a* and a rotor 2*b*, and the rotor 2*b* is fixed to the driving shaft 6 by shrinkage fitting. The electrically driving element 2 is formed by a brushless motor to increase the motor efficiency, and the driving thereof is controlled by a three-phase inverter. The electrically driving element 2 may be of another motor type, for example, a d.c. motor or an induction motor.

Reference numeral 13 denotes lubricating oil accumulated at the bottom portion in the hermetic casing 3, and the lower end portion of the driving shaft 6 is submerged in the lubricating oil 13. Reference numeral 14 denotes a suction pipe, 15 denotes a discharge pipe, and 16 denotes the aforementioned working chamber formed by the engagement of the displacer 5 with the inner peripheral wall 4*a* and the vane 4*b* of the cylinder 4. Also, the discharge chamber 9*b* is isolated from the pressure in the hermetic casing 3 by a seal member 17 such as an O-ring.

In the case where the displacement type fluid machine of this embodiment is used as a compressor for air conditioning, the flow of the working gas (refrigerant gas) is explained with reference to FIGS. 1A and 1B. As is indicated by arrow marks in the figure, the working gas entering the hermetic casing 3 through the suction pipe 14 goes into the suction cover 11 installed to the main bearing 8, and further goes into the displacement type compression element 1 through the suction port 8*a*. At this time, the displacer 5 is revolved by the rotation of the driving shaft 6, so that the volume of the working chamber is decreased, whereby the working gas is compressed. The compressed working gas passes through the discharge port 9*a* formed in the end plate of the subsidiary bearing 9, and pushes up the discharge valve 10*a*, going into the discharge chamber 9*b*. Then, the working gas flows out to the outside through the discharge pipe 15. The reasons for a gap being formed between the suction pipe 14 and the suction cover 11 are that the electrically driving element is cooled by the working gas caused to flow in the hermetic casing 3 and that incompressible liquids (lubricating oil, liquid refrigerant, etc.) contained in the working gas are effectively separated.

The lubricating oil 13 accumulated in the hermetic casing 3 is sent from the bottom portion to each sliding part through an oil feed hole 6*b* formed in the driving shaft 6 and through oil holes 6*c* and 6*d* communicating with the oil feed hole 6*b* by the pressure difference or the centrifugal pump operation to give lubrication to each sliding part. Some of the lubricating oil 13 is supplied into the working chamber through the gap.

Figure 4A:
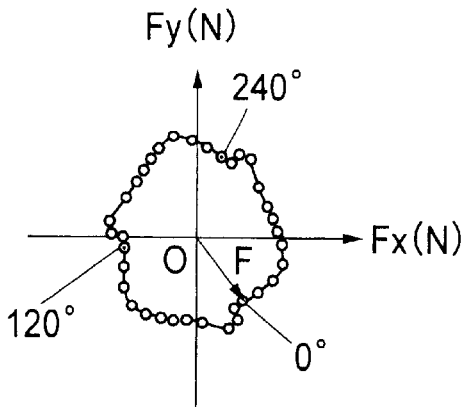
FIG. 4A is a polar diagram of a load applied to a displacer driving bearing of a displacement type fluid machine in accordance with the present invention.
Figure 4B:
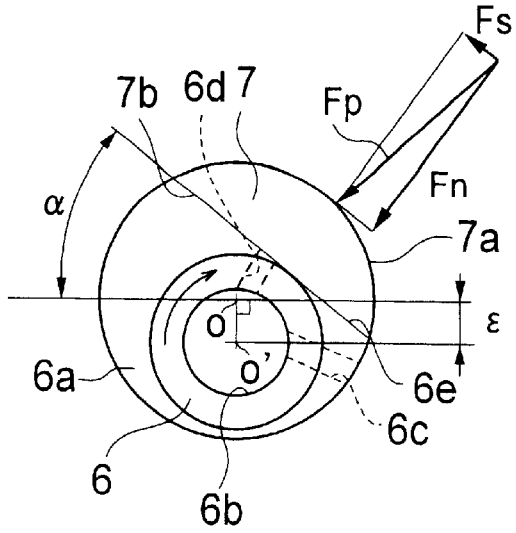
FIG. 4B is an explanatory view of the generation of a seal force of a driving mechanism portion.
Figure 5:
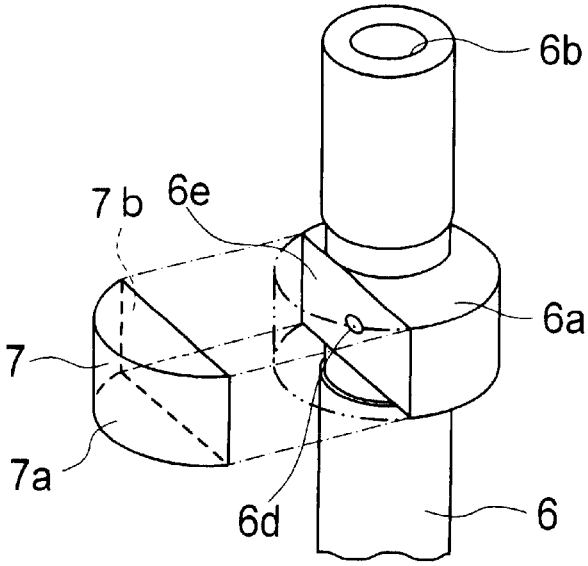
FIG. 5 is a perspective view of an essential portion of a driving mechanism of a displacement type fluid machine in accordance with the present invention.
Figure 6A:
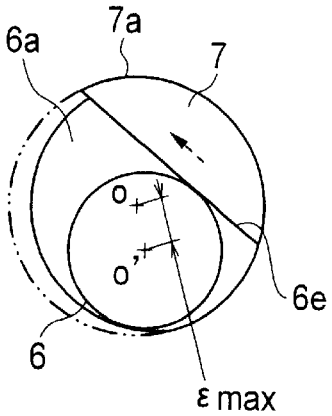
FIGS. 6A to 6C are explanatory views showing orbiting radius variable operation at a driving mechanism portion of a displacement type fluid machine in accordance with the present invention.
Figure 6B:
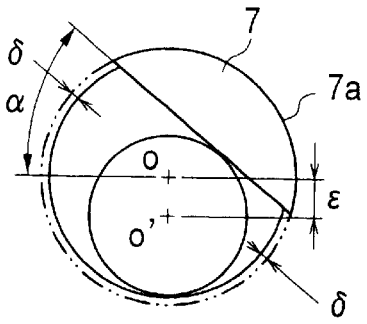
Figure 6C:
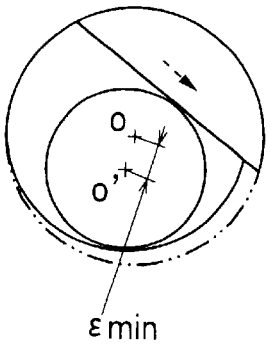
Figure 7:
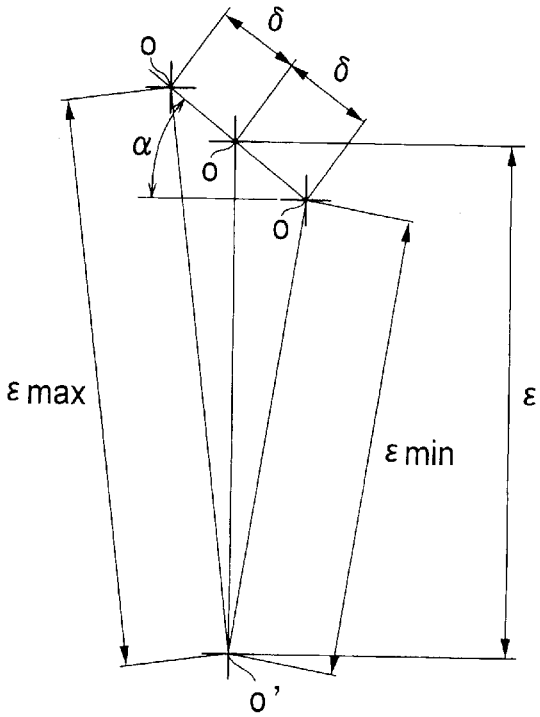
FIG. 7 is a schematic view showing an orbiting radius variable range in FIGS. 6A to 6C.
Figure 8:
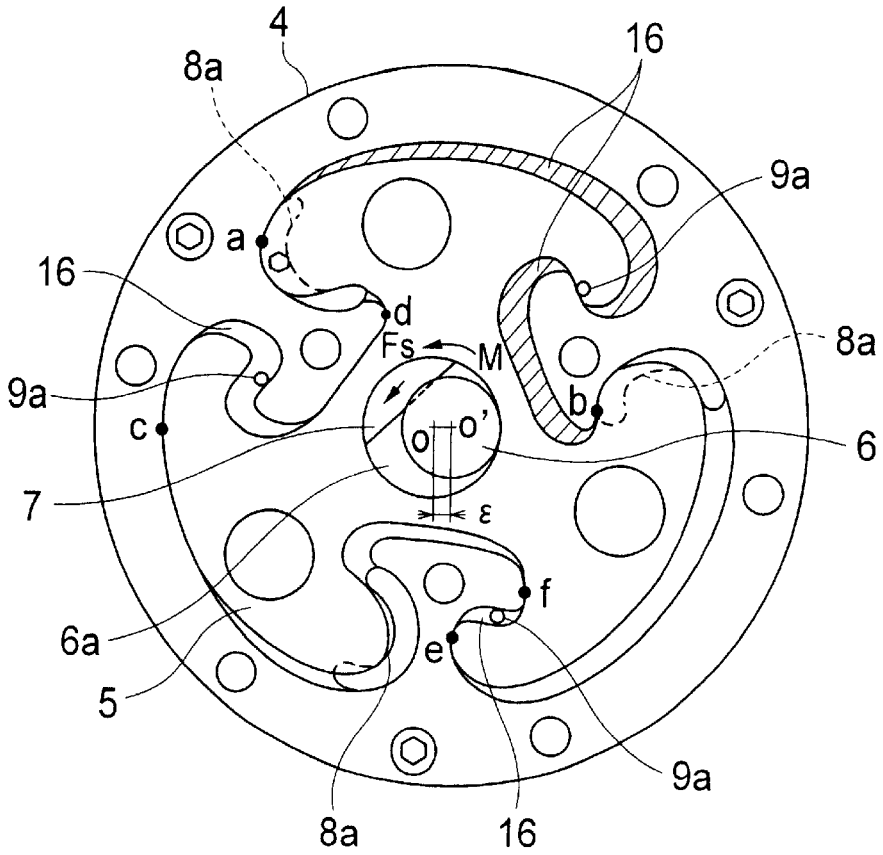
FIG. 8 is an explanatory view of a contacting state of seal points due to a rotation moment and a seal force acting on a displacer of a displacement type fluid machine in accordance with the present invention.
Figure 9:
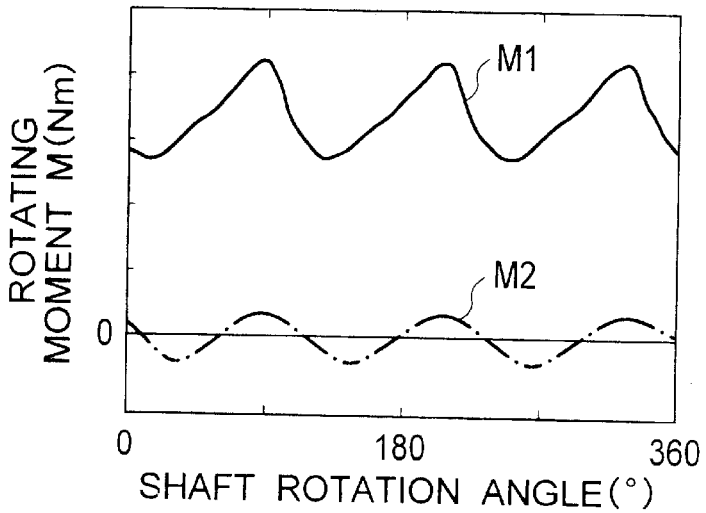
FIG. 9 is a graph showing an example of calculation of rotating moment acting on a displacer.

Next, an example of a driving mechanism in which the orbiting radius ϵ of the displacer 5 is changed, which is a feature of the displacement type compression element 1 in accordance with the present invention, will be explained with reference to FIGS. 4 to 9. FIG. 4A are polar diagrams of a load F applied to the displacer driving bearing 5*a* of the displacement type fluid machine in accordance with the present invention. FIG. 4B is an explanatory view of a mechanism for the generation of a seal force Fs of a driving mechanism portion. FIG. 5 is a perspective view of an essential portion of the driving mechanism for the displacement type fluid machine in accordance with the present invention. FIGS. 6A to 6C are explanatory views of orbiting radius variable operation at the driving mechanism portion of the displacement type fluid machine in accordance with the present invention. FIG. 7 is a schematic view showing an orbiting radius variable range in FIGS. 6A to 6C. FIG. 8 is an explanatory view of a contacting state of seal points due to a rotating moment M and a seal force Fs acting on the displacer of the displacement type fluid machine in accordance with the present invention. FIG. 9 is a graph showing an example of calculation of rotating moment acting on the displacer.

The polar diagram of load applied to the driving bearing 5*a* of the displacer 5, shown in FIG. 4A, shows a calculation result under refrigerating conditions (for example, working fluid is HFC134a, suction pressure Ps=0.095 MPa, and discharge pressure Pd=1.043 MPa) of the displacement type compression element 1 shown in FIGS. 1A and 1B, which is represented by a stationary coordinate system in which the center o of the displacer 5 is the origin. The numerals in the figure indicate the rotation angle of the driving shaft 6. Fx and Fy indicate an x-direction component force and a y-direction component force, respectively, of a bearing load Fp. This diagram shows that the vector locus of a bearing load Fp of the displacement type compression element 1 of the present invention is a substantially circular locus, and the bearing load is a rotational load in which the load direction also rotates with the rotation of the driving shaft. This means that when viewed by a rotating coordinate system in which the driving shaft is fixed, the load F acts on the driving shaft 6 from a substantially fixed direction, and the load face of the driving shaft is fixed, and it is found that this displacement type fluid machine satisfies the basic requirements for utilizing some of the bearing load Fp as a seal force.

Next, a mechanism in which the seal force Fs is generated will be described with reference to FIGS. 4B and 5. In the figures, a slide face 6*e* is formed in a form such that the eccentric portion 6*a* of the driving shaft 6 is partially cut away, and a slide face 7*b* of the substantially segment shaped slider 7 having a partial cylinder shape engages with the slide face 6*e* and slides. The slide face 6*e* of the eccentric portion 6*a* is formed so as to be inclined through an angle α with respect to a plane which passes through the center o of the displacer 5 and is perpendicular to a line connecting the center o to the center o' of the driving shaft 6. This angle α is referred to as a slide angle. Also, a cylindrical portion 7*a* of the slider 7 fits in the driving bearing 5*a* of the displacer 5, and constitutes an oil film pressure generating portion which is subjected to the bearing load Fp by the fluid lubricating action. If the oil film thickness of the bearing is neglected, the center o of the displacer 5 is the center of the cylindrical portion 7*a* of the slider 7. Reference numeral 6*d* denotes the oil hole for supplying lubricating oil to the slide face 6*e*.

Thereupon, the bearing load Fp is decomposed into a component Fn perpendicular to the slide face 6*e* and a component Fs parallel to the slide face 6*e*. The load component Fs parallel to the slide face 6*e* acts so as to push up the slider 7 along the slant surface (the direction shown in FIG. 4B is taken as the positive direction of the load Fs), and acts so as to increase the orbiting radius ϵ (=oo') and to decrease a clearance of contact points (seal points) of engagement of the cylinder 4 with the displacer 5. That is to say, a seal force is applied to each seal point, so that the internal leakage of working fluid can be decreased so that the performance of compressor can be enhanced. The component Fs in the direction of the slide face 6*e* of the bearing load Fp serves as a seal force. Considering the operating conditions (suction pressure, discharge pressure, rotational speed, etc.) of the compressor, the value of the slide angle a is set so that a proper seal force Fs (Fs>0) always acts.

Thus, the mechanism is configured relatively simply by two parts: the driving shaft having the eccentric portion formed with a planar portion in which the outside diameter face is partially cut away, and the substantially segment shaped slider having the oil film pressure generating portion for supporting the load applied to the displacer driving bearing, which engages with the planar portion of the driving shaft and slides. Therefore, this mechanism can provide less costly orbiting radius variable means.

Next, the orbiting radius variable operation and variable range in this driving mechanism will be explained with reference to FIGS. 6A to 6C. In FIG. 6B, the outside diameter of the eccentric portion 6*a* of the driving shaft 6 is smaller by a radius gap δ than the outside diameter (indicated by a two-dot chain line) of the oil film pressure generating portion 7*a* which corresponds the cylindrical portion of the slider 7. From this dimension setting state, the slider 7 slides along the slide face 6*e* of the eccentric portion 6*a* as indicated by an arrow mark of broken line. A state in which the orbiting radius ϵ is at a maximum is represented by reference character ϵmax in FIG. 6A, and a state in which the orbiting radius is at a minimum is represented by reference character ϵmin in FIG. 6C. FIG. 7 schematically shows this dimensional relationship. Thereupon, the orbiting radius variable range can be regulated arbitrarily by the dimension of the radius gap δ.

For example, in the case where the slide angle α is 35°, if the radius gap δ is 75 μm, the orbiting radius ϵ is variable in the range of about ±44 μm. By changing the orbiting radius ϵ in a wide range in this manner, the accuracy of the contour of the cylinder 4 and the displacer 5 can be relaxed, and the optimum orbiting radius matching the absolute dimensions of the two elements, which is necessary when the orbiting radius is fixed, need not be selected, so that the assembling ability can be enhanced significantly.

Further, the contact points (seal points) of engagement of the cylinder 4 with the displacer 5 slide relatively at a peripheral speed $v=\epsilon\cdot\omega$ of the radius ϵ, where ω is a rotational angular velocity of the driving shaft 6. Even if these movement line contact portions are worn, an increase in clearance is prevented by an increased orbiting radius ϵ, so that the wear is compensated. Therefore, a decrease in performance caused by wear can be prevented. The orbiting radius variable range is determined by considering the motion traceability, wear compensation range, etc. of the slider 7, but the lower limit value thereof is regulated so as to be more than the contour errors of the cylinder and the displacer from the viewpoint of assembling ability.

Next, the contacting state of seal points caused by the rotating moment M acting on the displacer by means of the compression of working fluid and the aforementioned seal force Fs will be explained with reference to FIG. 8. The displacer 5 is subjected to a force caused by the internal pressure of each working chamber 16 along with the compression of working fluid. When the line of action of the resultant force does not pass through the center o of the displacer 5, a moment (rotating moment M) which tends to rotate the displacer 5 itself is generated. In the displacement type compression element 1 of the present invention, this rotating moment is a counterclockwise moment as shown in FIG. 8. As is apparent from the figure, the contact points (seal points) that can be subjected to this rotating moment M are three points of a, b and d. Ideally, these three points come into contact at the same time, but considering the accuracy of contours of the cylinder 4 and the displacer 5, at least any one point of these three points comes into contact. Next, the contact point created by the aforementioned seal force Fs is considered. The seal force Fs acts so that the slider 7 slides in the direction such that the orbiting radius $\epsilon$ is increased, by which at least any one point of three points of c, e and f other than the aforementioned three points comes into contact.

The seal point c has a large radius of curvature, and internal leakage is less prone to occur. Therefore, if the contour is corrected so that a gap is produced positively to avoid the contact, either one point of the contact points created by the seal force Fs of the two seal points e and f comes into contact. (The working chamber sealed by the symbols e and f operates as discharge pressure and seals between an adjacent space operating as suction pressure and the working chamber. Like this, pressure difference at the seal points is large, and consequently it becomes difficult to seal such a form having a small radius of curvature. In the present embodiment, the seal characteristic of these seal points is strengthened by the seal force Fs.) This corresponds to the contact point in the case where a moment in the direction opposite to the rotating moment M acts. Thus, by the driving mechanism in which the orbiting radius $\epsilon$ is variable, at the seal point on the side subjected to the rotating moment caused by the reaction force of working fluid compression acting on the displacer 5 and at the seal point on the side subjected to the moment in the direction opposite to this rotating moment, one or more movement line contact portions are provided. For the displacer 5, therefore, the angular displacement in the rotation direction is regulated at least two seal points, so that the behavior thereof is made stable. As a result, the rotational angular displacement around the center o can be decreased, so that vibration and noise can be reduced.

This shows that the contours of the cylinder 4 and the displacer 5 can further be improved from the viewpoint of performance and reliability. The curve M1 in FIG. 9 shows a calculation result of the rotating moment acting on the displacer 5 in the displacement type compression element 1 of the present invention under the aforementioned refrigerating conditions of HFC134a. FIG. 9 shows that the rotating moment Ml takes a positive value during one rotation of the driving shaft, so that a unidirectional moment always acts. When the orbiting radius $\epsilon$ is constant, the displacer must always be subjected to a unidirectional moment to prevent seal points from being separated (to prevent tooth separation vibration from occurring) from the viewpoint of vibration and noise. However, in this driving mechanism in which the orbiting radius is variable, this restricting condition is unnecessary, and the contours of the cylinder and the displacer can be selected in which the rotating moment is alternating so that the value of the rotating moment is switched between positive and negative as in the case of the rotating moment M2 in FIG. 9.

The state in which the rotating moment is alternating in this manner provides the smallest absolute value of moment, and can reduce most the contact load of the seal point caused by the rotating moment. Therefore, the mechanical friction loss of the movement line contact portion (seal point) is decreased, thereby increasing the performance, and also the reliability against the wear of contact portion can further be improved.

Figure 10:
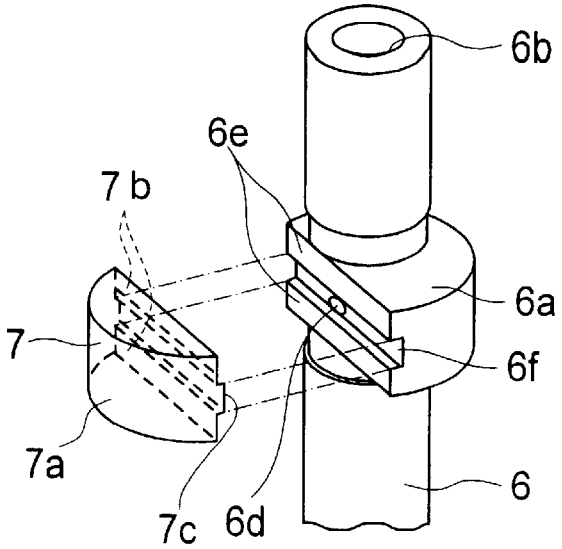
FIG. 10 is a perspective view of an essential portion of another driving mechanism of a displacement type fluid machine in accordance with the present invention.

FIG. 10 is a perspective view of an essential portion of another driving mechanism of a displacement type fluid machine in accordance with the present invention. In FIG. 10, reference numeral **6*f* denotes a guide groove formed in the slide face 6*e* provided in a form in which the eccentric portion 6*a* of the driving shaft 6 is partially cut away. The guide groove 6*f* engages with a projecting guide portion 7*c* formed on the slide face 7*b* of the slider 7 so as to guide the sliding motion of the slider 7 along the driving shaft slide face 6*e*. The guide groove 6*f* communicates with the oil hole 6*d* of the driving shaft 6, and is also used as an oil groove for lubricating to the slide face 7*b* and the guide portion 7*c* of the slider 7. The guide groove 6*f* is formed perpendicularly to the axis of the driving shaft 6 to decrease a gap between the guide groove 6*f* and the guide portion 7*c* of the slider 7, by which the sliding direction of the slider 7 is regulated so as to be the angle perpendicular to the axis of the driving shaft 6. Therefore, the axial vibrations of the slider 7 and the displacer 5 fitting to the slider 7** are restrained, thereby decreasing the vibration and noise of the displacement type fluid machine.

In the above-described embodiment, that is, the embodiment shown in FIG. 3, there has been described a hermetic type compressor of a type in which the pressure in the hermetic casing 3 is kept at a low pressure (suction pressure). This low-pressure type has the following advantages:

(1) The electrically driving element 2 is less heated by the compressed high-temperature working gas, and is cooled by the suction gas. Therefore, the temperatures of the stator **2*a* and the rotor 2*b*** decrease, so that the motor efficiency is increased, whereby the performance can be enhanced.

(2) For a working fluid compatible with the lubricating oil 13, such as flon, the low pressure decreases the percentage of a working gas dissolved in the lubricating oil 13. Therefore, the foaming phenomenon of oil in the bearing etc. becomes less prone to occur, whereby the reliability can be increased.

(3) The pressure in the hermetic casing 3 can be decreased, so that the hermetic casing 3 can be thin-walled and light in weight.

Figure 11:
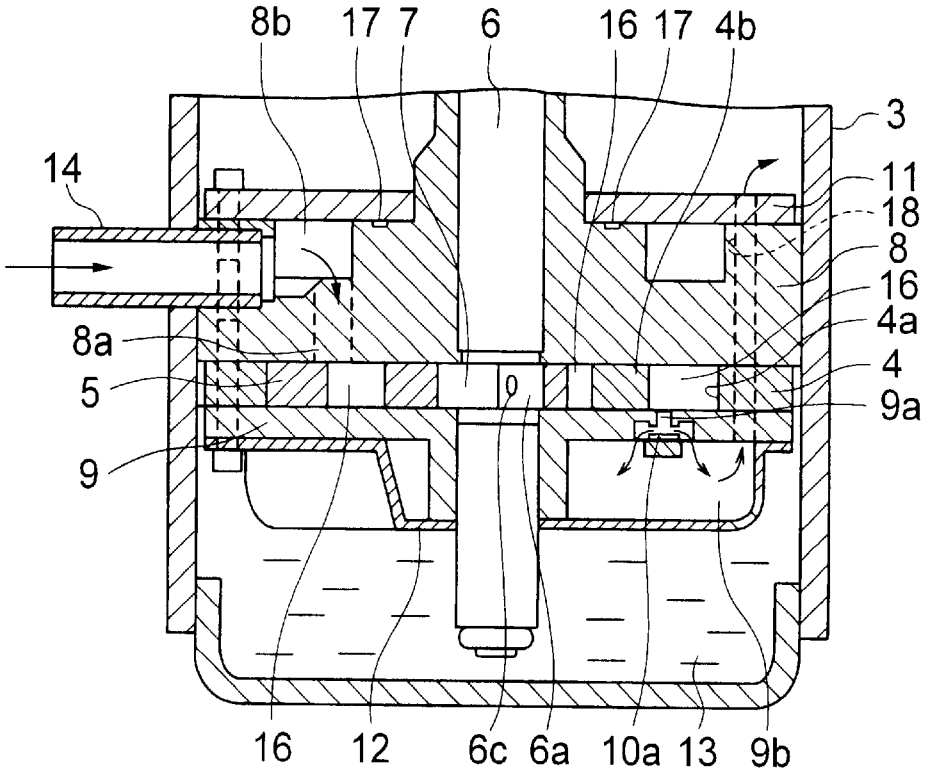
FIG. 11 is a longitudinal sectional view of an essential portion of a hermetic type compressor in accordance with another embodiment of the present invention.

The following is a description of a type in which the pressure in the hermetic casing 3 is kept at a high pressure (discharge pressure). FIG. 11 is a longitudinal sectional view of an essential portion of a hermetic type compressor of a high-pressure type in a case where a displacement type fluid machine in accordance with another embodiment of the present invention is used as a compressor. In FIG. 11, elements to which the same reference numeral as that of FIGS. 1 to 3 is applied are the same elements those shown in FIGS. 1 to 3, and perform the same operation. In the figure, reference numeral 8*b* denotes a suction chamber formed integrally with the main bearing 8 by the suction cover 11, which is isolated from the pressure (discharge pressure) in the hermetic casing 3 by a seal member 17 or the like. Reference numeral 18 denotes a discharge passage for connecting the interior of the discharge chamber 9*b* to the interior of the hermetic casing 3. The operation principle etc. of the displacement type compression element 1 is the same as that of the low-pressure (suction pressure) type.

The working gas flows as indicated by arrow marks in FIG. 11. The working gas entering the suction chamber 8*b* through the suction pipe 14 goes into the displacement type compression element 1 through the suction port 8*a* formed in the main bearing 8. At this time, the displacer 5 is revolved by the rotation of the driving shaft 6, so that the volume of the working chamber 16 is decreased, whereby the working gas is compressed. The compressed working gas passes through the discharge port 9*a* formed in the end plate of the subsidiary bearing 9, pushes up the discharge valve 10*a*, going into the discharge chamber 9*b* and passes through the discharge passage 18, entering the closed vessel 3. Then, the working gas flows out to the outside through the discharge pipe (not shown) connected to the hermetic casing 3.

The advantage of such a high-pressure type is as follows: Since the lubricating oil 13 has a high pressure, the lubricating oil 13 supplied to each bearing sliding portion by centrifugal pump operation etc. caused by the rotation of the driving shaft 6 passes through a gap etc. on the end face of the displacer 5 and is easily supplied into the cylinder 4, so that the sealing ability of the working chamber 16 and the lubricating ability of the sliding portion can be increased.

For the compressor using the displacement type fluid machine in accordance with the present invention, either the low-pressure type or the high-pressure type can be selected according to the specifications, application, or production facility of equipment, so that the degree of freedom for design increases significantly.

Figure 12:
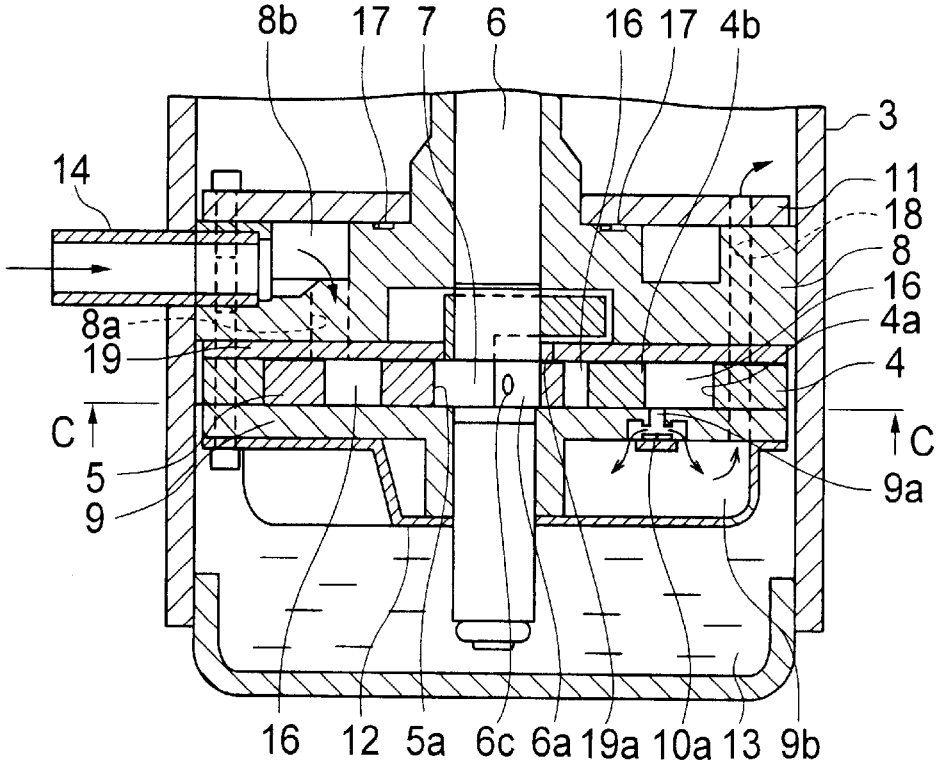
FIG. 12 is a longitudinal sectional view of an essential portion of a hermetic type compressor in accordance with still another embodiment of the present invention.
Figure 13:
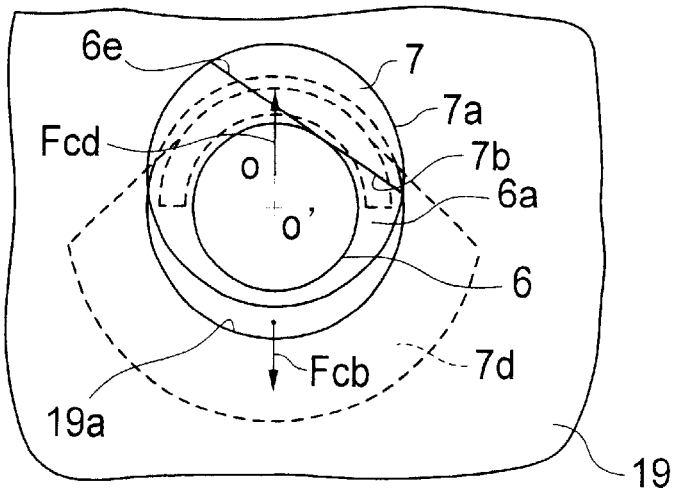
FIG. 13 is a view taken in the direction of the arrows along the line C—C of the essential portion of the driving mechanism shown in FIG. 12.
Figure 14:
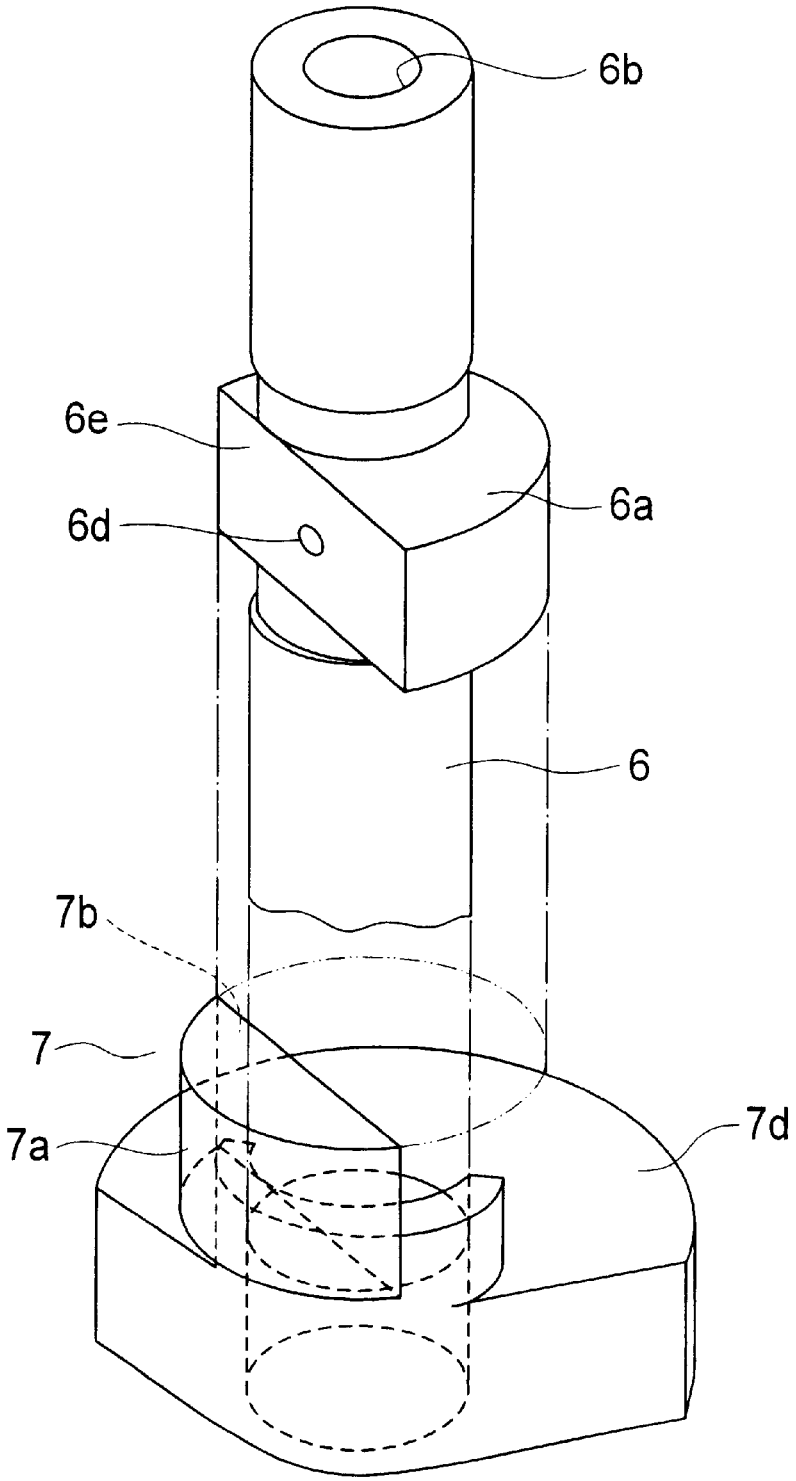
FIG. 14 is a perspective view of the essential portion of the driving mechanism shown in FIG. 12.

Next, still another embodiment of the present invention will be described. FIG. 12 is a longitudinal sectional view of an essential portion of a hermetic type compressor of a high-pressure type in accordance with still another embodiment of the present invention. FIG. 13 is a view taken in the direction of the arrows along the line C—C of an essential portion of a driving mechanism shown in FIG. 12. FIG. 14 is a perspective view of the essential portion of the driving mechanism shown in FIG. 12. In FIG. 12, elements to which the same reference numeral as that of FIGS. 1 to 3 and FIG. 11 is applied are the same elements those shown in FIGS. 1 to 3 and FIG. 11, and perform the same operation. In the figure, reference numeral 7*d* denotes a counter weight formed integrally with the slider 7, and the eccentric mass thereof is determined so as to be balanced against a centrifugal force Fcd of the displacer 5. Taking the centrifugal force caused by the eccentric mass of the counter weight 7*d* as Fcb, Fdb is equal to Fcd. Reference numeral 8*c* denotes a counter weight chamber which is a space formed at the central portion of the main bearing 8 so as to contain the counter weight 7*d* by means of a partitioning plate 19, and 19*a* denotes a through hole in the central portion of the partitioning plate 19. The inside diameter of the through hole 19*a* is larger than the outside diameter of the oil film pressure generating portion 7*a*, which is the cylindrical portion of the slider 7, so that the slider 7 integral with the counter weight 7*d* can be mounted.

In this embodiment, the centrifugal force Fcd of the displacer 5 is canceled by the centrifugal force Fcb of the counter weight 7*d* attached integrally to the slider 7, so that the bearing load F of the driving shaft 5*a* of the displacer 5 does not include the influence of inertia force, and only a load caused by the compression of working gas is applied. Therefore, the seal force Fs utilizing part of the bearing load Fp also has no inertia force, and is not affected by the rotational speed of the driving shaft 6.

Figure 15:
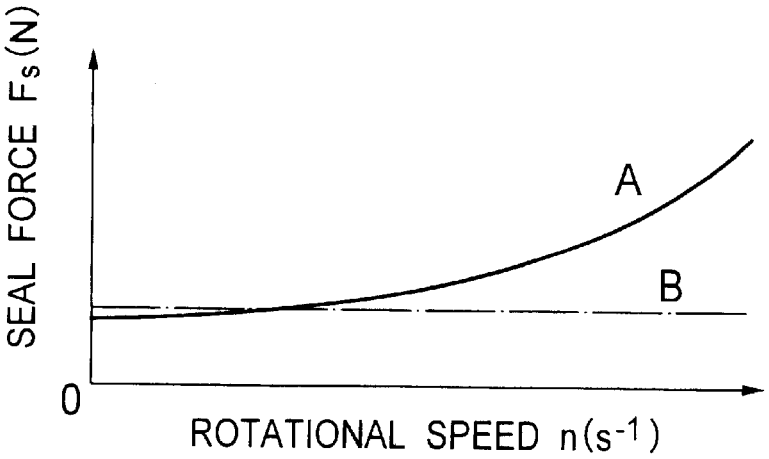
FIG. 15 is a graph for illustrating a relationship between rotational speed and seal force.

FIG. 15 shows a relationship between the rotational speed n of the driving shaft and the seal force Fs. In the case where there is the influence of inertia force, the seal force Fs increases with the increase in the rotational speed n as shown by a curve A in FIG. 15 under the same pressure condition. In the case of this embodiment, however, the seal force Fs has a constant value independently of the rotational speed as shown in the figure. Since the seal force Fs can be set so as to be the optimum seal force for keeping the sealing function, high performance can be achieved in a wide rotation range especially in a driving mechanism suitable for an inverter machine in which the rotational speed of the driving shaft varies widely. In this embodiment, the centrifugal force Fcb of the counter weight and the centrifugal force Fcd of the displacer balance with each other completely. However, in the case where the variation range of rotational speed is not so wide, the eccentric mass of the counter weight may be set so as to balance with part of the centrifugal force of the displacer. In this case as well, the influence of inertia force can be made weak, so that the effect of increasing high-speed performance can be achieved.

The above is a description of a displacement type fluid machine having three vanes 4*b* at the inner periphery of the cylinder 4. The present invention is not limited to this configuration, and can be expanded to a displacement type fluid machine having N ($N \geqq 2$) number of vanes 4*b* (the value of N is practically not higher than 8 to 10). As the number N of vanes gradually increases in the practical range in this manner, the following advantages are offered.

(1) The torque fluctuation becomes small, thereby decreasing vibration and noise.

(2) When the cylinder has the same outside diameter, the cylinder height for securing the same suction volume decreases, so that the dimension of the compression element can be decreased.

(3) Since the rotating moment acting on the displacer becomes small, the mechanical friction loss at the sliding portion between the displacer and the cylinder can be reduced, so that the reliability can be increased.

(4) The pressure pulsation in the suction and discharge pipes becomes low, so that low vibration and low noise can further be attained. Thereby, a non-pulsating fluid machine (compressor, pump, etc.) demanded in medical and industrial applications can be made possible.

Figure 16:
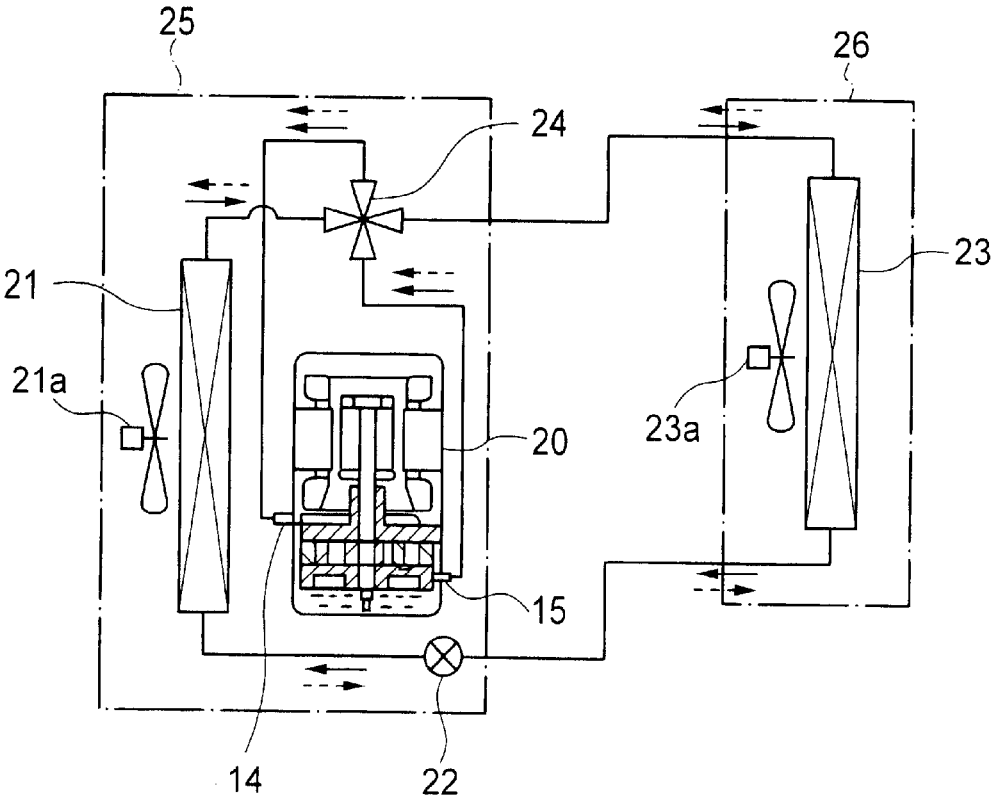
FIG. 16 is a schematic view of an air-conditioning system to which a displacement type compressor in accordance with the present invention is applied.

FIG. 16 shows an air-conditioning system to which a displacement type compressor in accordance with the present invention is applied. This cycle, which is a heat pump cycle capable of performing cooling and heating, comprises a displacement type compressor 20 of the present invention, having been explained with reference to FIG. 3, an outdoor heat exchanger 21 and a fan 21*a* therefor, an expansion valve 22, an indoor heat exchanger 23 and a fan therefor, and a four-way valve 24. A dot-dash-line 25 indicates an outdoor unit, and 26 indicates an indoor unit.

The displacement type compressor 20 operates according to the operation principle shown in FIGS. 2A to 2D. By starting the compressor, the compressive operation of a working fluid (for example, flon HCFC22, R407C, and R410A) is carried out between the cylinder 4 and the displacer 5.

In case of cooling operation, the compressed high-temperature, high-pressure working fluid, passing through the four-way valve 24 through the discharge pipe 15, flows into the outdoor heat exchanger 21 as indicated by arrow marks of broken line. The gas is cooled and liquefied by the air blowing operation of the fan 21*a*. The liquefied refrigerant is expanded by the expansion valve 22, so that the refrigerant is made a low-temperature, low-pressure liquid by adiabatic expansion. After the refrigerant is gasified by absorbing heat in a room by the indoor heat exchanger 23, the gas is sucked into the displacement type compressor 20 through the suction pipe 14. On the other hand, in the case of heating operation, the refrigerant flows in the direction opposite to the direction for cooling operation as indicated by arrow marks of solid line. The compressed high-temperature, high-pressure working gas, passing through the four-way valve 24 through the discharge pipe 15, flows into the indoor heat exchanger 23. The gas dissipates heat into a room by means of the air blowing operation of the fan 23*a* and is liquefied. The liquefied refrigerant is expanded by the expansion valve 22, so that the refrigerant is made a low-temperature, low-pressure liquid by adiabatic expansion. After the refrigerant is gasified by absorbing heat from the outside air by the outdoor heat exchanger 23, the gas is sucked into the displacement type compressor 20 through the suction pipe 14.

Figure 17:
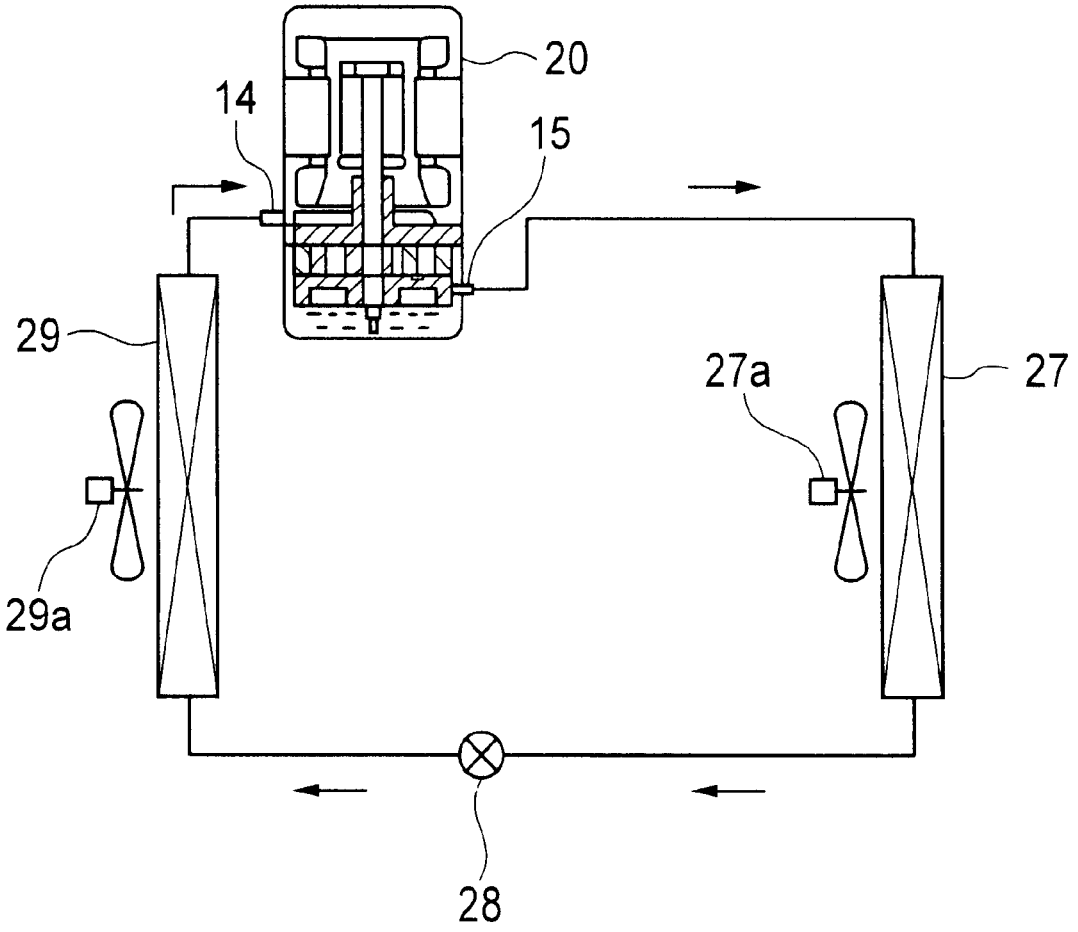
FIG. 17 is a schematic view of a refrigeration system to which a displacement type compressor in accordance with the present invention is applied.

FIG. 17 shows a refrigeration system in which a displacement type compressor in accordance with the present invention is mounted. This cycle is a cycle exclusive to refrigeration (cooling). In FIG. 17, reference numeral 27 denotes a condenser, 27*a* denotes a condenser fan, 28 denotes an expansion valve, 29 denotes an evaporator, and 29*a* denotes an evaporator fan.

By starting the displacement type compressor 20, the compressive operation of a working fluid is carried out between the cylinder 4 and the displacer 5. The compressed high-temperature, high-pressure working gas flows into the condenser 27 through the discharge pipe 15 as indicated by an arrow mark of solid line. The gas is cooled and liquefied by the air blowing operation of the fan 27*a*. The liquefied refrigerant is expanded by the expansion valve 22, so that the refrigerant is made a low-temperature, low-pressure liquid by adiabatic expansion. After the refrigerant is gasified by absorbing heat by means of the evaporator 29, the gas is sucked into the displacement type compressor 20 through the suction pipe 14. In both of the systems shown FIGS. 16 and 17, since the system is mounted with the displacement type compressor in accordance with the present invention, reliable refrigeration and air-conditioning systems with high energy efficiency and low vibration and noise can be obtained. Although the displacement type compressor 20 has been described above taking the low-pressure type by way of example, the high-pressure type also functions in the same way, and can achieve the same effect.

Although the displacement type fluid machine has been described taking the compressor by way of example in the embodiment described above, the present invention can also be applied to a pump, an expansion machine, and a power machine. Also, the motion mode in which one element (cylinder) is fixed and the other element (displacer) revolves with an orbiting radius $\epsilon$ without rotation has been described, the present invention can be applied to a displacement type fluid machine in which both of the elements are rotated so as to provide a motion mode relatively equivalent to the above motion.

The following is a description of a variable crank mechanism in accordance with another embodiment of the present invention.

Figure 18:
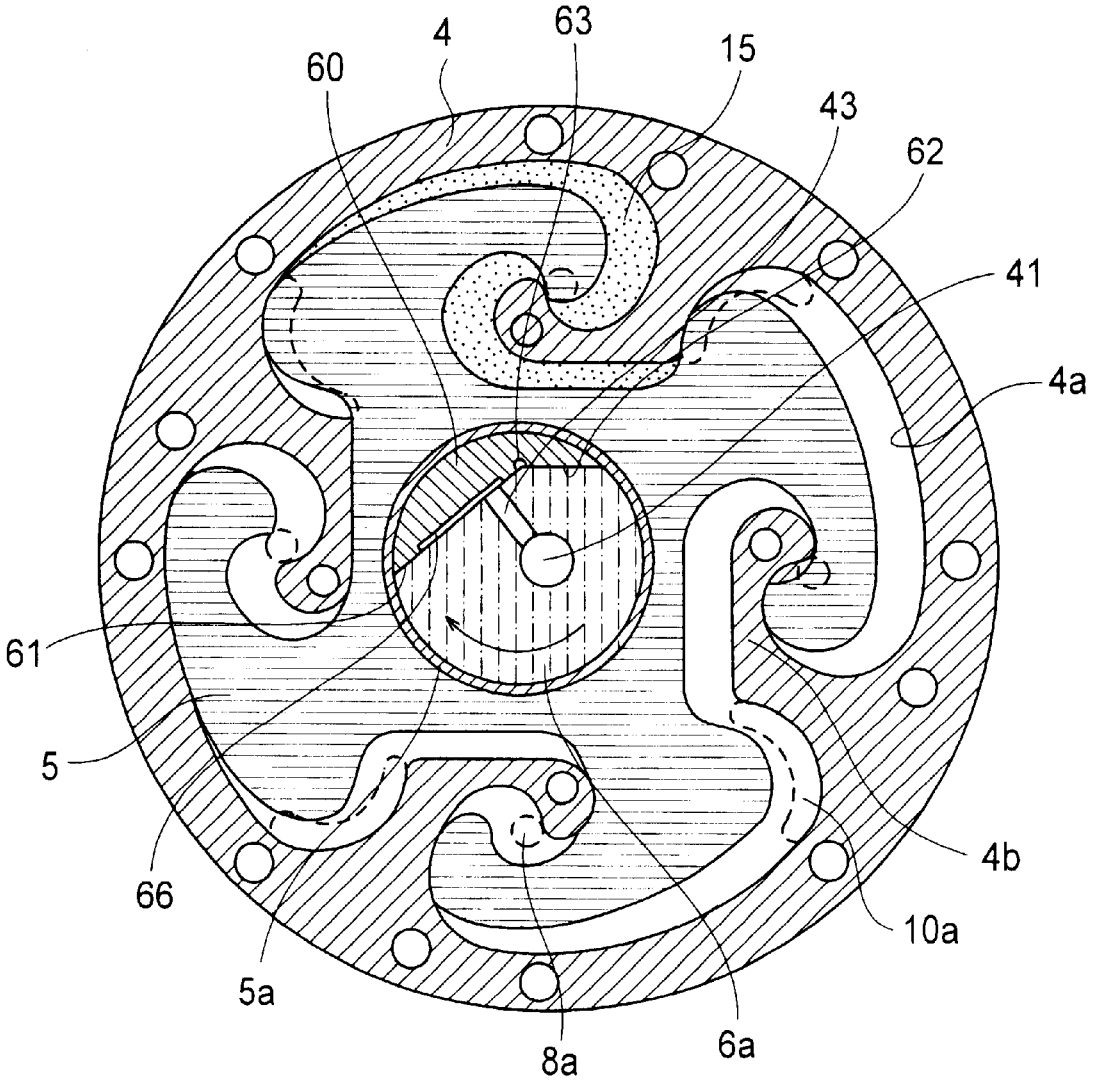
FIG. 18 is a sectional view similar to that of FIG. 1B in accordance with another embodiment of the present invention.
Figure 19:
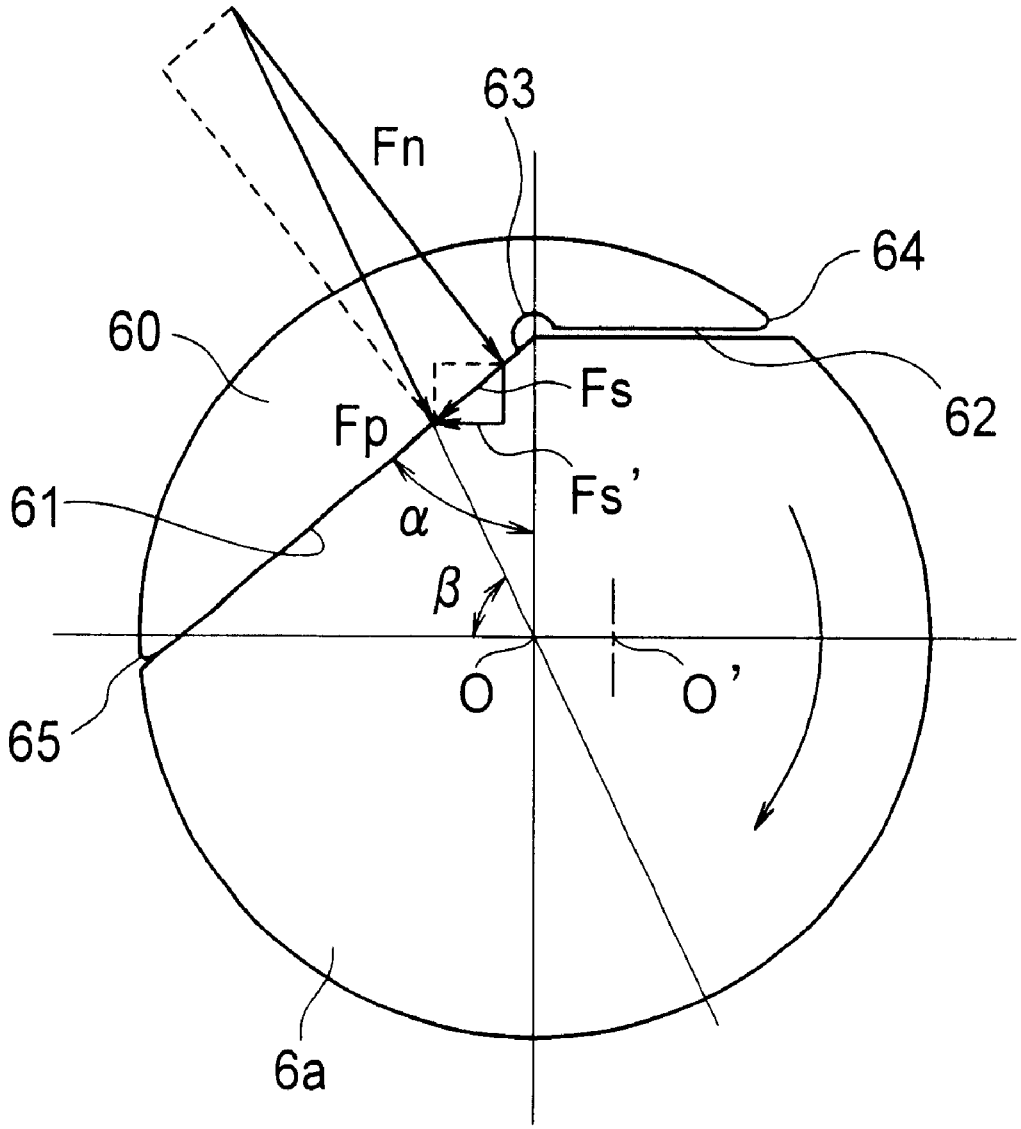
FIG. 19 is a plan view of a variable crank mechanism portion in accordance with the present invention.
Figure 20:
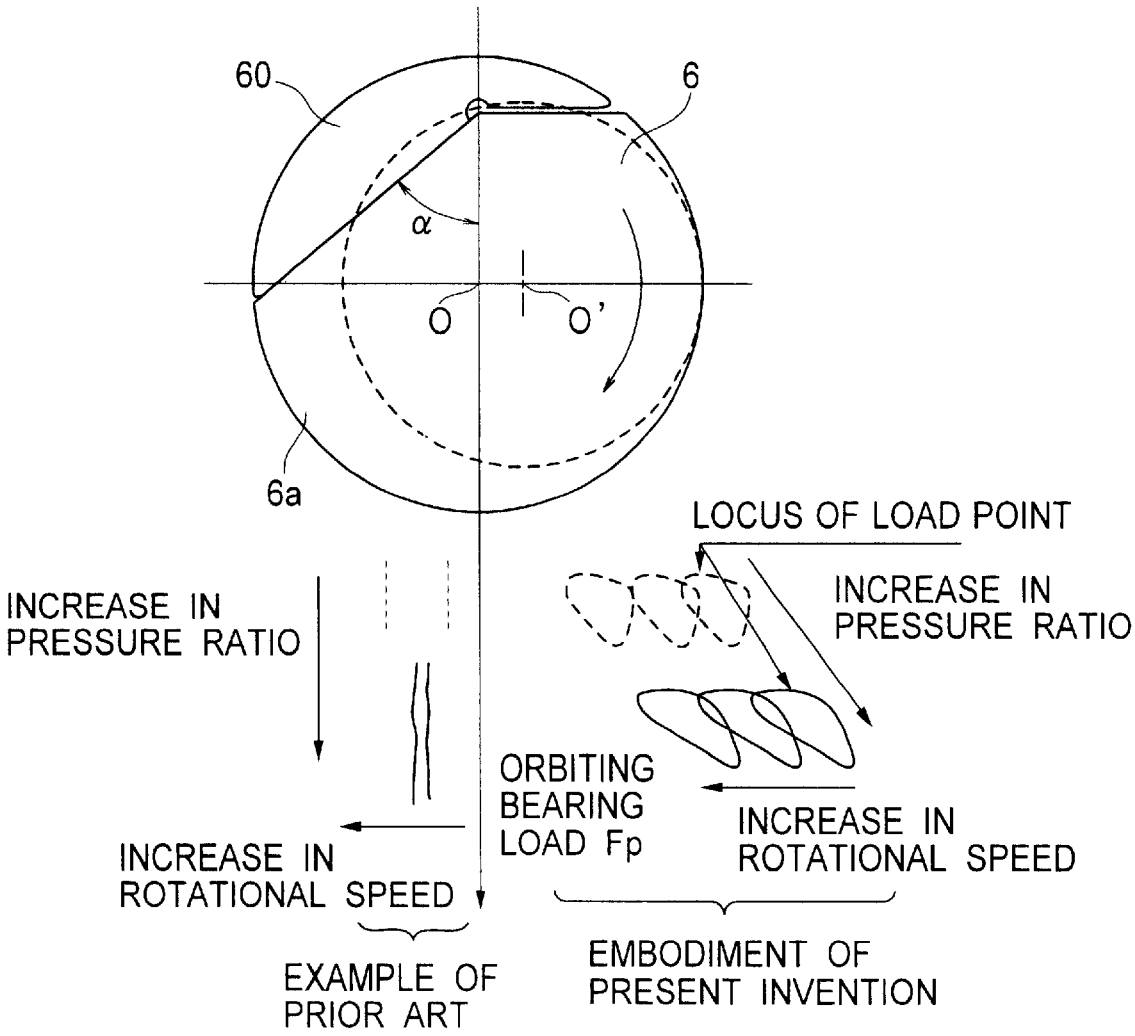
FIG. 20 is a view showing the magnitude and direction of a load applied to an orbiting bearing in the present invention.
Figure 21:
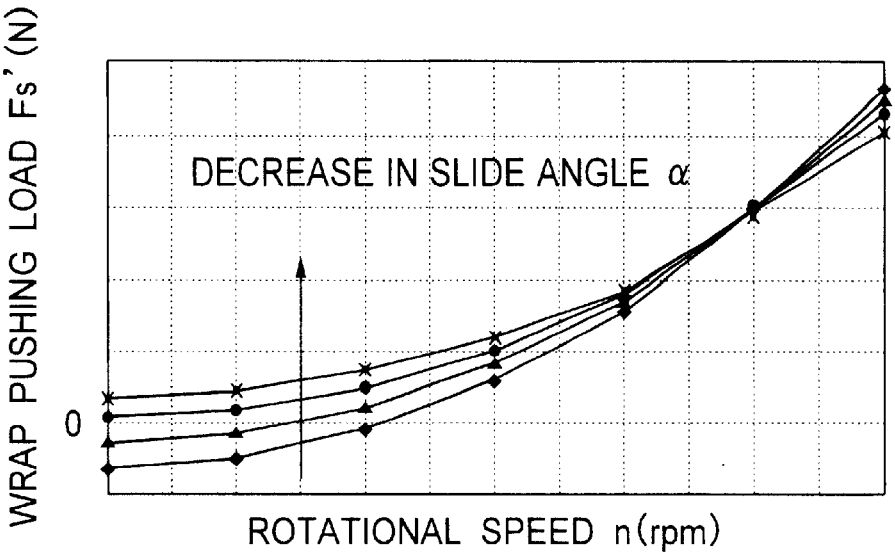
FIG. 21 is an explanatory diagram representing the characteristics of a wrap pushing load of the displacer 5 in the present invention.
Figure 22:
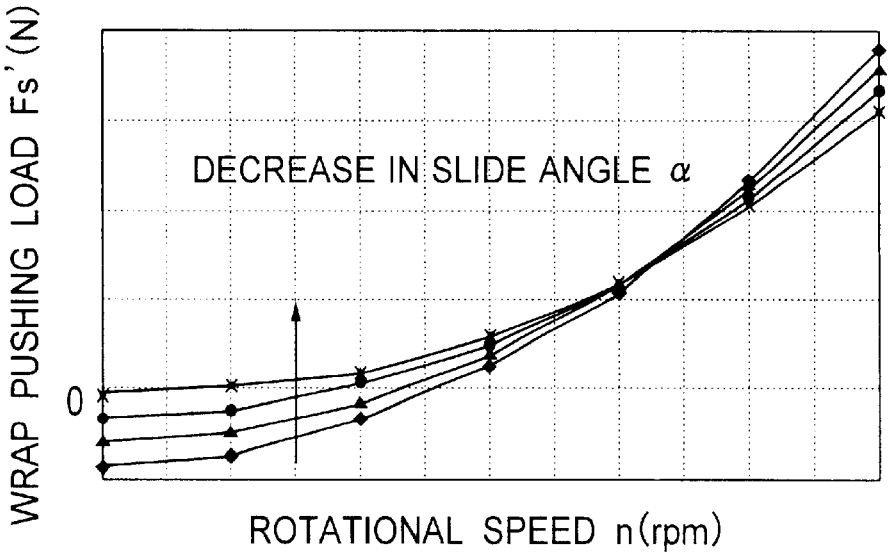
FIG. 22 is an explanatory diagram representing the characteristics of a wrap pushing load of the displacer 5 in the present invention.

FIG. 18 is a sectional view similar to that of FIG. 1B, FIG. 19 is a plan view of a variable crank mechanism portion showing the embodiment of the present invention, FIG. 20 is a view showing the magnitude and direction of a load applied to an orbiting bearing, and FIGS. 21 and 22 are explanatory diagrams representing the characteristics of a wrap pushing load of the displacer 5.

Referring to FIG. 18, a slider 60 is installed between an orbiting bearing 5*a* pressed into the inner peripheral portion of the displacer 5 and a crankshaft (an eccentric portion) 6*a*. The slider 60 has a chevron shape, and the outer periphery thereof has a cylindrical shape because it serves as a sliding face with respect to the orbiting bearing 5*a*. The inside of the slider 60 has two faces: a sliding face 61 with respect to the crankshaft 6*a* and a face 62 formed so as to have a gap between the same and the crankshaft 6*a*. These two inside faces 61 and 62 are connected to each other by an arcuate portion 63. Therefore, the crankshaft 6*a* confronting the inside faces 61 and 62 is also composed of two planes and a cylindrical face. In the slider 60, the cylindrical face and two planes are connected to each other by arcs 64 and 65, and the sliding face 61 with respect to the crankshaft 6*a* is provided with oil holding means 66. The lubricating method will be described later.

The outer peripheral length of the cylindrical face of the slider 60 is approximately ⅓ or more of the inner peripheral length of the orbiting bearing, which provides a so-called partial bearing construction. This is because the variable crank mechanism is formed effectively in a limited space. Specifically, the construction of a slider bearing (a slider block is inserted in a crank pin portion cut into two parallel faces, and the whole outer periphery of the slider block is slid with respect to the orbiting bearing) used in the prior art is applied to a compressor of this embodiment. Considering the strength of the crankshaft, the outside diameter of the orbiting bearing increases, and the outside diameter of the compressor increases. Inversely, if the outside diameter of the compressor is equal, the diameter of the crankshaft decreases, so that the strength of the crankshaft decreases, or the characteristics of the bearing are degraded.

The above-described configuration is suitable to satisfy both the characteristics in a limited space. Also, since the sliding face 61 of the slider 60 is open, the face can be machined easily. Further, the cylindrical face of the slider 60, which is a portion subjected to an orbiting bearing load, described later, is determined from the load capacity thereof and the formation of oil film thickness by lubricating oil.

The sliding face 61 of the slider 60 has an inclined angle (hereinafter referred to as a slide angle) $\alpha$ with respect to the eccentric direction of the displacer 5 as shown in FIG. 19. The displacer 5 is subjected to a resultant force Fp of a gas compression load caused by the compression of working gas, a reaction force of rotating moment, a centrifugal force of the displacer 5, etc. This resultant force Fp constitutes an orbiting bearing load because it is carried by the orbiting bearing 5*a* of the displacer 5.

Next, a method for determining the slide angle $\alpha$ will be explained.

The slide angle $\alpha$ has only to be determined so that the slider 60 is always moved slightly along the slide angle in the lower left direction in FIG. 19 by the orbiting bearing load Fp. On the sliding face 61 of the slider 60, there act a component force Fn of the orbiting bearing load Fp acting perpendicularly to the sliding face and a component force Fs acting in parallel with the sliding face. The slider 60 is moved slightly along the slide angle in the lower left direction in FIG. 19 by this component force Fs, and further the displacer 5 is pushed in the eccentric direction by an eccentric-direction component force Fs' of Fs. As a result, the aforementioned clearance of contact points (seal points) of engagement of displacer 5 with the inner peripheral wall 4*a* and the vane 4*b* of the cylinder 4 can basically be made zero.

When the eccentric-direction component force Fs' of Fs is referred to as a wrap pushing load, and the acting direction of the orbiting bearing load Fp is taken as β with respect to the eccentric direction of the displacer 5, the wrap pushing load Fs' is expressed by the following equation.

$$Fs' = -Fp \cos(\pi/2 - \alpha + \beta) \sin \alpha \quad (1)$$

As seen from Equation (1), the acting direction β of the orbiting bearing load Fp is essential in order to always make the wrap pushing load Fs' positive (the left direction in FIG. 19 is taken as positive).

FIG. 20 shows the magnitude and acting direction of the orbiting bearing load Fp. This figure compares the locus of load point between the embodiment of the present invention and the prior art (scroll compressor) by using a coordinate system on a rotating shaft 6. For comparison, the theoretical stroke volume is made equal.

For both of the embodiment of the present invention and the prior art (scroll compressor), the rotational speed n of the compressor and the ratio of discharge pressure to suction pressure (pressure ratio) of the compressor are changed. In the scroll compressor, the acting direction of the orbiting bearing load Fp does not change so much with respect to the rotational speed and the pressure ratio, being substantially perpendicular to the eccentric direction. Contrarily, in the embodiment of the present invention, the acting direction thereof changes with respect to the rotational speed and the pressure ratio. That is, the magnitude and acting direction of the orbiting bearing load Fp change according to the operating conditions of the compressor. In FIG. 20, the locus of load point in the embodiment of the present invention is a closed curve having a "omusubi" (rice ball) shape. This closed curve is drawn four times (because of four wraps) during one rotation of the rotating shaft 6. In the embodiment of the present invention, the acting direction of the orbiting bearing load Fp changes with the rotation of the driving shaft 6, so that the maximum and minimum values of the acting direction β are essential in determining the slide angle.

FIGS. 21 and 22 show rotational speed characteristics of the wrap pushing load Fs' by taking slide angle α as the parameter at the maximum and minimum values of the acting direction β of the orbiting bearing load Fp when the discharge pressure and the suction pressure of compressor are fixed. The wrap pushing load Fs' increases with the increase in the rotational speed and the decrease in the slide angle α of compressor. Also, the wrap pushing load Fs' is larger in the case where the slide angle α is set at the maximum with respect to the acting direction β of the orbiting bearing load Fp than in the case where the slide angle α is set at the minimum. This can be explained qualitatively by using FIGS. 19 and 20. However, for the rotational speed, the characteristics are reversed at a certain rotational speed.

As described above, the slide angle α of the slider 60 must be determined at the minimum value of the acting direction β of the orbiting bearing load Fp.

By the above-described configuration, the variable crank mechanism can be configured effectively in a limited space, and the method for machining the slider can be simplified.

The following is a description of a lubricating construction for the whole of the compressor.

The lower end of the rotating shaft 6 is steeped in the lubricating oil 13 stored at the bottom portion of the hermetic casing 3, the rotating shaft 6 is formed with an oil feed passage 41 communicating with the lubricating oil 13.

Also, the oil feed passage 41 is provided with a subsidiary bearing oil feed hole (not shown), an orbiting bearing oil feed hole 43, and a main bearing oil feed hole (not shown), which are formed so as to face outward in the radial direction in such a manner as to communicate with each bearing.

An oil feed construction for the variable crank mechanism portion will now be described with reference to FIGS. 18 and 19.

The crankshaft 6*a* is formed with the oil feed passage 41 communicating with the oil storage portion 12 for lubricating oil 13 stored at the bottom portion of the hermetic casing 3. The oil feed passage 41 communicates with an oil pocket serving as oil holding means 66 provided in the sliding face 61 of the slider 60 through the orbiting bearing oil feed hole 43. As an alternative to the oil holding means 66, self-lubricating materials or the like can be laminated. Also, a gap is provided between the other face 62 of the slider 60 and the crankshaft 6*a*. This is because the gap prevents the interference of the two faces with each other when the slider 60 moves slightly and the gap has an operation as an oil feed passage for lubricating oil. Further, the cylindrical face and the two planes are connected to each other by the arcs 64 and 65, whereby a relief portion is formed. The relief portion 64 scrapes up lubricating oil with the rotation of the crankshaft 6*a*, and the relief portion 65 avoids the intrusion of slider between the orbiting bearing 5*a* and the crankshaft 6*a* by a wedge operation when the slider moves slightly.

Thereupon, with the rotation of the rotating shaft 6, the lubricating oil stored at the bottom portion of the hermetic casing 3 is pushed up into the oil feed passage 41 by the centrifugal pump operation.

The oil flowing into the orbiting bearing oil feed hole 43 goes into the oil pocket 66 to give lubrication to the sliding face 61 of the slider 60.

The lubricating oil in the oil feed passage 41 gives lubrication to each bearing and also is supplied to each sliding part of the displacer 5 and the cylinder 4 through oil feed means (not shown) formed in the displacer 5 and the cylinder 4 by the pressure difference from the working chamber 16.

By the above-described configuration, an oil film pressure that can fully attain the load capacity as a partial bearing can be produced, and the lubrication to the sliding portion of the slider can surely be provided.

Figure 23:
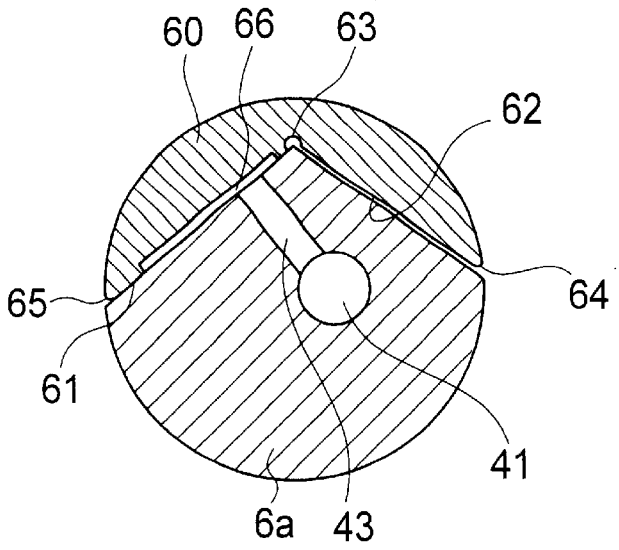
FIG. 23 is a sectional view of a variable crank mechanism portion in accordance with another embodiment of the present invention.

Next, another embodiment of the present invention will be described. FIG. 23 is a sectional view of a variable crank mechanism portion in accordance with another embodiment of the present invention. In FIG. 23, elements to which the same reference numeral as that of the embodiment shown in FIGS. 18 to 19 is applied perform the same operation.

The feature of this embodiment is that the outer peripheral length of the cylindrical face of the slider 60 is about ½ of the inner peripheral length of the orbiting bearing. That is, the slide angle is made equal, and the angle between the two inside faces 61 and 62 of the slider 60 is made small.

By the above-described configuration, an oil film generating region can be increased.

Figure 24:
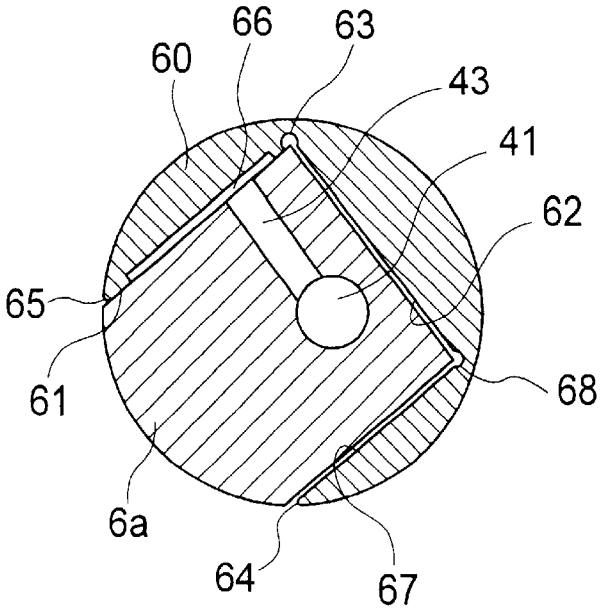
FIG. 24 is a sectional view of a variable crank mechanism portion in accordance with still another embodiment of the present invention.

Next, still another embodiment of the present invention will be described. FIG. 24 is a sectional view of a variable crank mechanism portion in accordance with still another embodiment of the present invention. In FIG. 24, elements to which the same reference numeral as that of the embodiment shown in FIGS. 23 to 19 is applied perform the same operation.

The feature of this embodiment is that the slider 60 has a concave shape, and the outer peripheral length of the cylindrical face is about ¾ of the inner peripheral length of the orbiting bearing. That is, an inside face 67 is formed on the opposite side to the sliding face 61, a gap is provided between the inside face 67 and the crankshaft 6*a*, and a relief portion 64 is provided at the tip end of the inside face 67. Also, the inside faces 62 and 67 are connected to each other by an arc 68.

By the above-described configuration, the holding amount of lubricating oil on the inside faces 62 and 67 can be increased.

The above-described embodiment is not limited to a displacement type fluid machine of a both-end-supported construction in which the load acting on the crankshaft is supported by two bearings on both sides, and can be applied to a displacement type fluid machine of a one-end-supported construction with the achievement of the above effects.

As described above in detail, according to the present invention, there is provided driving means of a simple construction in which when the displacer is revolved to compress the working fluid, the bearing load applied to the displacer driving bearing is used to make the orbiting radius variable. Thereby, the workability and assembling ability are enhanced, and the internal leakage of working fluid is reduced, whereby the performance can be increased, and also a less costly displacement type fluid machine with high reliability can be obtained. Also, the configuration is such that oil holding means is provided in the sliding portion of the slider, and the oil feed holes are provided so as to communicate with the oil storage portion for lubricating oil and to communicate with the oil feed passage and the oil feed pipe having centrifugal pump operation, by which oil can be supplied surely to the sliding portion. Therefore, a highly reliable displacement type fluid machine can be obtained. Also, by mounting such a displacement type fluid machine in a refrigerating cycle, a highly reliable refrigeration and air-conditioning system with high energy efficiency can be obtained.

What is claimed is:

1. A displacement type fluid machine in which a displacer and a cylinder are disposed between end plates, one space is formed by the inside wall face of said cylinder and the outside wall face of said displacer when the center of said cylinder and the center of said displacer are aligned with each other, and a plurality of working chambers are formed when the positional relationship between said displacer and said cylinder is formed so as to be an orbiting position, wherein there is provided driving means for effecting orbital motion of said displacer, in which the orbiting radius of the orbital motion of said displacer changes along the shape of a movement line contact portion of the inside wall face of said cylinder and the outside wall face of said displacer at the time of actual operation, said driving means directing in a predetermined direction a part of a bearing load applied to a bearing for supporting a driving shaft of said driving means.

2. A displacement type fluid machine in which a displacer and a cylinder are disposed between end plates, one space is formed by the inside wall face of said cylinder and the outside wall face of said displacer when the center of said cylinder and the center of said displacer are aligned with each other, and a plurality of working chambers are formed when the positional relationship between said displacer and said cylinder is formed so as to be an orbiting position, wherein the inside wall face of said cylinder and the outside wall face of said displacer each have one or more movement line contact portions at a seal point on the side subjected to a rotation moment caused by a reaction force of working fluid compression acting on said displacer and at a seal point on the side subjected to a moment in the direction opposite to the rotation moment.

3. A displacement type fluid machine in which a displacer and a cylinder are disposed between end plates, one space is formed by the inside wall face of said cylinder and the outside wall face of said displacer when the center of said cylinder and the center of said displacer are aligned with each other, and a plurality of working chambers are formed when the positional relationship between said displacer and said cylinder is formed so as to be an orbiting position, wherein there is provided driving means for revolving said displacer, in which when said displacer is revolved to compress a working fluid, said driving means directs a part of a bearing load applied to a driving bearing of said displacer in a predetermined direction to act as a seal force at a seal point between said displacer and said cylinder.

4. A displacement type fluid machine comprising a cylinder having an inside wall composed of a curve such that a planar shape is continuous between end plates, and a displacer having an outside wall provided so as to be opposed to the inside wall of said cylinder, which is formed with a plurality of working chambers by said inside wall, said outside wall, and said end plates at the time of orbital motion, wherein there is provided driving means for revolving said displacer, in which the radius of revolving motion (orbital motion) of said displacer is variable at least in a range wider than the shape errors of said displacer and said cylinder, said driving means directing in a predetermined direction a part of a bearing load applied to a bearing for supporting a driving shaft of said driving means.

5. A displacement type fluid machine comprising a cylinder having an inside wall composed of a curve such that a planar shape is continuous between end plates, and a displacer having an outside wall provided so as to be opposed to the inside wall of said cylinder, which is formed with a plurality of working chambers by said inside wall, said outside wall, and said end plates at the time of orbital motion, wherein there is provided driving means for revolving said displacer, in which when said displacer is revolved to compress a working fluid, said driving means directs a part of a bearing load applied to a driving bearing of said displacer in a predetermined direction to act as a seal force at a seal point between said displacer and said cylinder, and the planar shapes of the inside wall of said cylinder and the outside wall of said displacer are formed so that an alternating moment in which the direction of a rotating moment acting on said displacer is changed over.

6. A displacement type fluid machine comprising a cylinder having an inside wall composed of a curve such that a planar shape is continuous between end plates, and a displacer having an outside wall provided so as to be opposed to the inside wall of said cylinder, which is formed with a plurality of working chambers by said inside wall, said outside wall, and said end plates at the time of orbital motion, wherein there is provided driving means for revolving said displacer which has a counter weight balancing with all or part of the centrifugal force of displacer and makes the radius of revolution (orbiting radius) of displacer variable.

7. The displacement type fluid machine according to claim 1, 3, 4, 5 or 6, wherein said driving means has a driving shaft one end of which is fixed to an electrically driving element and which has an eccentric portion formed with a planar portion in which the outside diameter face is partially cut away, and a substantially segment shaped slider having a partial cylinder shape which slides in engagement with the planar portion of said driving shaft and has a oil film pressure generating portion for supporting a load applied to a displacer driving bearing.

8. The displacement type fluid machine according to claim 7, wherein there is provided a guide portion for regulating the sliding direction of slider in a plane perpendicular to the axis of said driving shaft.

9. The displacement type fluid machine according to claim 1, 3, 4, 5 or 6, wherein said driving means has a driving shaft one end of which is fixed to an electrically driving element and which has an eccentric portion, and a slider which slides with respect to said driving shaft, and said slider has a face sliding with respect to said driving shaft, which is formed into a V shape.

10. The displacement type fluid machine according to claim 1, 3, 4, 5 or 6, wherein said driving means has a driving shaft one end of which is fixed to an electrically driving element and which has an eccentric portion, and a slider which slides with respect to said driving shaft, and said slider has a face sliding with respect to said driving shaft, which is formed into a U shape.

11. The displacement type fluid machine according to claim 9 or 10, wherein there is provided a passage for feeding oil via said driving shaft to a sliding face between said slider and said driving shaft.

12. The displacement type fluid machine according to claim 9 or 10, wherein the outer peripheral length of the load face of said slider is ⅓ or more of the inner peripheral length of the bearing of displacer.

13. The displacement type fluid machine according to claim 6, wherein said driving means directs in a predetermined direction a part of a bearing load applied to a bearing for supporting a driving shaft of said driving means.

14. A displacement type fluid machine in which a displacer and a cylinder are disposed between end plates, one space is formed by the inside wall face of said cylinder and the outside wall face of said displacer when the center of said cylinder and the center of said displacer are aligned with each other, and a plurality of working chambers are formed when the positional relationship between said displacer and said cylinder is formed so as to be an orbiting position, wherein there is provided driving means in which the orbiting radius of the orbital motion of said displacer changes along the shape of a movement line contact portion of the inside wall face of said cylinder and the outside wall face of said displacer at the time of actual operation, wherein said driving means has a driving shaft one end of which is fixed to an electrically driving element and which has an eccentric portion formed with a planar portion in which the outside diameter face is partially cut away, and a substantially segment shaped slider having a partial cylinder shape which slides in engagement with the planar portion of said driving shaft and has a oil film pressure generating portion for supporting a load applied to a displacer driving bearing.

15. A displacement type fluid machine in which a displacer and a cylinder are disposed between end plates, one space is formed by the inside wall face of said cylinder and the outside wall face of said displacer when the center of said cylinder and the center of said displacer are aligned with each other, and a plurality of working chambers are formed when the positional relationship between said displacer and said cylinder is formed so as to be an orbiting position, wherein there is provided driving means in which when said displacer is revolved to compress a working fluid, part of a bearing load applied to a driving bearing of said displacer is applied as a seal force at a seal point between said displacer and said cylinder, wherein said driving means has a driving shaft one end of which is fixed to an electrically driving element and which has an eccentric portion formed with a planar portion in which the outside diameter face is partially cut away, and a substantially segment shaped slider having a partial cylinder shape which slides in engagement with the planar portion of said driving shaft and has a oil film pressure generating portion for supporting a load applied to a displacer driving bearing.

16. A displacement type fluid machine comprising a cylinder having an inside wall composed of a curve such that a planar shape is continuous between end plates, and a displacer having an outside wall provided so as to be opposed to the inside wall of said cylinder, which is formed with a plurality of working chambers by said inside wall, said outside wall, and said end plates at the time of orbital motion, wherein there is provided driving means in which the radius of revolving motion (orbital motion) of said displacer is variable at least in a range wider than the shape errors of said displacer and said cylinder, wherein said driving means has a driving shaft one end of which is fixed to an electrically driving element and which has an eccentric portion formed with a planar portion in which the outside diameter face is partially cut away, and a substantially segment shaped slider having a partial cylinder shape which slides in engagement with the planar portion of said driving shaft and has a oil film pressure generating portion for supporting a load applied to a displacer driving bearing.

17. A displacement type fluid machine comprising a cylinder having an inside wall composed of a curve such that a planar shape is continuous between end plates, and a displacer having an outside wall provided so as to be opposed to the inside wall of said cylinder, which is formed with a plurality of working chambers by said inside wall, said outside wall, and said end plates at the time of orbital motion, wherein there is provided driving means in which when said displacer is revolved to compress a working fluid, part of a bearing load applied to a driving bearing of said displacer is applied as a seal force at a seal point between said displacer and said cylinder, and the planar shapes of the inside wall of said cylinder and the outside wall of said displacer are formed so that an alternating moment in which the direction of a rotating moment acting on said displacer is changed over, wherein said driving means has a driving shaft one end of which is fixed to an electrically driving element and which has an eccentric portion formed with a planar portion in which the outside diameter face is partially cut away, and a substantially segment shaped slider having a partial cylinder shape which slides in engagement with the planar portion of said driving shaft and has a oil film pressure generating portion for supporting a load applied to a displacer driving bearing.

18. The displacement type fluid machine according to claim 14, 15, 16 or 17, wherein there is provided a guide portion for regulating the sliding direction of slider in a plane perpendicular to the axis of said driving shaft.

19. The displacement type fluid machine according to claim 14, 15, 16 or 17, wherein said driving means has a driving shaft one end of which is fixed to an electrically driving element and which has an eccentric portion, and a slider which slides with respect to said driving shaft, and said slider has a face sliding with respect to said driving shaft, which is formed into a V shape.

20. The displacement type fluid machine according to claim 14, 15, 16 or 17, wherein said driving means has a driving shaft one end of which is fixed to an electrically driving element and which has an eccentric portion, and a slider which slides with respect to said driving shaft, and said slider has a face sliding with respect to said driving shaft, which is formed into a U shape.

* * * * *